US008265304B2

(12) United States Patent
Osborne

(10) Patent No.: US 8,265,304 B2
(45) Date of Patent: Sep. 11, 2012

(54) MICROPHONE SUITABLE FOR PROFESSIONAL LIVE PERFORMANCE

(76) Inventor: Gary T. Osborne, Indianapolis, IN (US)

( * ) Notice: Subject to any disclaimer, the term of this patent is extended or adjusted under 35 U.S.C. 154(b) by 338 days.

(21) Appl. No.: 12/633,824

(22) Filed: Dec. 9, 2009

(65) Prior Publication Data

US 2011/0135118 A1 Jun. 9, 2011

(51) Int. Cl.
*H04R 3/00* (2006.01)

(52) U.S. Cl. ..... 381/122; 92/111

(58) Field of Classification Search ..... 381/122, 381/359, 355, 150, 369, 120, 111, 107, 113, 381/106, 104, 92, 26; 704/500
See application file for complete search history.

(56) References Cited

U.S. PATENT DOCUMENTS

| | | | | |
|---|---|---|---|---|
| 3,336,441 | A | 8/1967 | Gorike | |
| 3,436,482 | A | 4/1969 | Pless et al. | |
| 3,604,853 | A | 9/1971 | Pless | |
| 4,000,370 | A | 12/1976 | Smith et al. | |
| 5,606,143 | A | 2/1997 | Young | |
| 5,739,452 | A | 4/1998 | Nagata | |
| 6,778,814 | B2 * | 8/2004 | Koike | 455/95 |
| 6,810,125 | B2 | 10/2004 | Oster et al. | |
| 7,262,358 | B2 | 8/2007 | Lubbers | |
| 2004/0096072 | A1 | 5/2004 | Orten | |
| 2004/0264726 | A1 * | 12/2004 | Gauger et al. | 381/369 |
| 2005/0232442 | A1 | 10/2005 | Seknicka | |
| 2006/0233395 | A1 | 10/2006 | Orten | |
| 2007/0237344 | A1 * | 10/2007 | Oster et al. | 381/113 |
| 2008/0101630 | A1 * | 5/2008 | Akino | 381/190 |

* cited by examiner

*Primary Examiner* — Con P Tran
(74) *Attorney, Agent, or Firm* — Anthony P. Filomena; Taft, Stettinius & Hollister, LLP

(57) ABSTRACT

A personal microphone that includes a structure having a live-performance form factor, a capsule that converts acoustic energy into an input signal, a signal processor that converts the input signal into a processed output signal, and a microphone output connector. The signal processor has input terminals that receive the input signal and input/output terminals that receive a phantom DC voltage from the microphone output connector while sending the microphone output connector a processed output signal. The signal processor has a dynamic range compressor that compresses the processed output signal, and a programming or adjustment device that sets the signal processor operating parameters. The personal microphone can have a security device for avoiding unwanted changes to the operating parameters of the adjustable signal processor. The personal microphone can be powered by a phantom power supply coupled to the microphone output connector via a mixing console and/or other devices.

30 Claims, 26 Drawing Sheets

MICROPHONE SUITABLE FOR PROFESSIONAL LIVE PERFORMANCE

BACKGROUND

This invention relates to a personal microphone having a form factor suitable for a professional user in a live performance. Professionals are motivated by financial profits and opportunities to advance one's career. They make recordings in recording studios and do live performances. In a recording studio, recording engineers spend time selecting and adjusting a variety of dynamic range compressors and other signal processors to improve the sound quality of the recording. Compressors are among the most important signal processors. Their proper setup and adjustment can be crucial to achieving high quality sound.

Signal processors are usually located in equipment racks and connected to performers' microphones via cables or wires. Or signal processors may be emulated by computer programs. In either case, time is required for plug-in and set-up.

However in live performances, setup time is a scarce commodity. Time constraints can arise from a variety of factors such as venue scheduling and labor rates. The performance hall may be leased to the performers at an hourly rate. To reduce cost and increase profit, setup time is kept to a minimum.

Time constraints can yield inconsistent results; the performers may give a good live performance one night and a bad performance the next. But the audience expects all performances to be like recordings they may have heard.

SUMMARY

Until now there has been a substantially unfulfilled need to make a live performance sound more like a studio recording while decreasing pre-performance setup time. In one embodiment of the invention a personal microphone has a programmable signal processor located inside the body of a stage microphone. The personal microphone has a capsule that provides an input signal. The signal processor processes the input signal and provides a processed output signal. The signal processor has a dynamic range compressor to compress the processed output signal.

The signal processor's operating parameters can be preprogrammed and stored in a nonvolatile memory in the signal processor. The nonvolatile memory can retain information when power is not applied. The operating parameters can be set to accommodate the performer's voice. For example, more compression can be given to a performer having a dynamic voice while less compression can be given to a less dynamic voice.

The personal microphone can be plugged into a mixing console having a phantom power supply. The phantom power supply can provide a phantom DC voltage to energize the signal processor. The signal processor can include a programming device that recalls the information from the memory and sets the operating parameters of the signal processor. These features enable the convenience of simply plugging-in and performing without the requirement of signal processor setup.

The personal microphone can have a security device to restrict access to the signal processor. The security device can cover or conceal the nonvolatile memory or its interface to help prevent unwanted changes to the operating parameters. The security device can prevent unauthorized users from changing the operating parameters of the signal processor.

The security device can also help prevent the performer himself/herself from accidentally changing the operating parameters when the microphone is handled during a performance.

The security device can be designed to not open spontaneously. In these embodiments, an action such as removing an access screw, entering a password, or plugging in an adaptor cable can be used to enable opening of the security device.

In another aspect of the invention, the capsule has a proximity effect bass boost when the personal microphone is held close to the performer's mouth. The personal microphone can include a removable ring for adjusting the bass boost to accommodate the performer's voice. A removable ring can be located between the windscreen and body of the microphone to decrease the bass boost. The removable ring can be removed to increase the bass boost. The personal microphone may be used for other sound sources such as musical instruments or instrument amplifiers.

A personal microphone that receives a phantom DC voltage and provides a processed output signal having a dynamic range is disclosed. The personal microphone includes a microphone output connector for receiving the phantom DC voltage and providing the processed output signal, a structure having a form factor for live performance, a capsule for converting acoustic energy into an input signal, and a programmable signal processor located in the structure for converting the input signal into the processed output signal. The microphone output connector can have pins arranged in a compatible pattern for coupling to a 3-pin female XLR connector. The programmable signal processor has signal input terminals coupled to the capsule for receiving the input signal and input/output terminals coupled to the microphone output connector for receiving the phantom DC voltage. The input/output terminals further provide the processed output signal to the microphone output connector. The programmable signal processor includes a dynamic range compressor to compress the dynamic range of the processed output signal, a nonvolatile memory device for storing information about the operating parameters of the programmable signal processor, and a programming device coupled to the nonvolatile memory device. The programming device retrieves the information from the nonvolatile memory device and sets the programmable signal processor operating parameters.

The personal microphone can include a security device for avoiding unwanted changes to the operating parameters of the programmable signal processor. The security device can include an access screw and an access hole in the structure. In this embodiment, to open the security device the access screw is unscrewed and the programmable signal processor is removed from the structure through the access hole. Having access to the programmable signal processor enables the user to change the information stored in the nonvolatile memory device.

The nonvolatile memory device can include a header with a pair of posts and a shunt. The shunt can be pushed onto the pair of posts to create a short circuit between the pair of posts to store the operating parameters. The information about the operating parameters of the programmable signal processor is stored as an arrangement of shunts on the header.

The personal microphone can include a computer having a pointing device, a display monitor and a computer program. The computer program can facilitate entering operating parameters into the nonvolatile memory device. The computer program can include a guide to arranging the shunt(s) on the header. The computer program can include a user interface for displaying representations of the operating parameters, with a virtual control and a virtual header representation. The virtual header representation displays a location of the shunt on the header. The virtual control is virtually moved with the pointing device to change the location of the shunt displayed by the virtual header representation. The display monitor displays a representation of the header and the shunt to provide guidance for arranging the shunt on the header.

The nonvolatile memory device can have a digital memory, and the programming device can include a microcontroller with a PROGRAMMING mode and a RUN mode. In the PROGRAMMING mode, the microcontroller can store information about the operating parameters in the digital memory. In the RUN mode, the microcontroller can recall the information from the digital memory and set the operating parameters. The information can be stored in the digital memory as a series of logical 1's and 0's.

The personal microphone can include a computer having a computer port, such as a USB port. The security device can include a programming adaptor for transferring data between the computer and the microcontroller during the PROGRAMMING mode of operation. The programming adaptor can include a computer connector coupled to the computer port and a programming connector. The programming connector can be an XLR connector which can be coupled to the microphone XLR output connector. The personal microphone can have an auxiliary connector. The programming adaptor's programming connector can be mechanically compatible with the auxiliary connector. The programming connector can be coupled to the auxiliary connector. The security device can be opened by coupling the programming adaptor between the computer connector and the microphone output connector.

The microcontroller can have a predetermined password and the microphone can have a secondary security device for avoiding unwanted changes to the operating parameters of the programmable signal processor. A user password can be entered by a user into the computer via a standard input device of the computer to open the secondary security device. The secondary security device confirms the user password and only allows changes to the operating parameters of the programmable signal processor when the user password matches the predetermined password. The microcontroller and/or the computer can compare the user password to the predetermined password. When the user password matches the predetermined password, the microcontroller can store the information about the operating parameters in the digital memory in the PROGRAMMING mode of operation.

The programming device can have a programming control with a switch where the switch is actuated to change the microcontroller to the PROGRAMMING mode, and the microcontroller changes the operating parameters in response to the switch being actuated.

The security device can include an access screw, a threaded hole in the structure, and a control cover for covering the programming control. The control cover includes a screw hole. In this embodiment, the access screw is inserted through the screw hole of the control cover and into the threaded hole in the structure to attach the control cover to the structure.

The security device can include a switch and a microcontroller having a predetermined password. The microcontroller can be programmed to monitor the switch for a sequence of key presses. A user can enter a user password by pressing and releasing the switch a predetermined number of times. The security device can confirm the user password and only allow changes to the operating parameters of the programmable signal processor when the user password matches the predetermined password.

The programmable signal processor can include a digital signal processor having an analog-to-digital converter, an arithmetic logic unit, and a digital-to-analog converter. The analog-to-digital converter can convert an analog signal derived from or the same as the input signal to an input digital signal, the arithmetic logic unit can receive the input digital signal and provide an output digital signal, and the digital-to-analog converter can convert the output digital signal into a processor output signal. The processed output signal is derived from the processor output signal.

To facilitate live performances, the structure of the personal microphone can have a stage-microphone form factor. This form factor includes a body having a proximal end and a distal end, an input end located at the proximal end of the body, an output end located at the distal end of the body, and a windscreen located at the input end of the body. The capsule can be located at the input end of the body behind the windscreen, and the microphone output connector can be coupled to the output end of the body.

The personal microphone can include a mixing console with a phantom power supply and a microphone cable. The microphone cable can have one end designated a first end and another end designate a second end. The microphone output connector is coupled to the first end of microphone cable and the mixing console is coupled to the second end of microphone cable. The microphone cable can have a 3-pin female XLR connector located at the first end to couple to the personal microphone's output connector. The second end of the microphone cable can have a male XLR connector coupled to the mixing console. The phantom power supply can provide the phantom DC voltage to the microphone output connector through the mixing console and the microphone cable.

The dynamic range compressor can have an automatic gain control for changing signal gain in response to an analog signal derived from or the same as the input signal. The automatic gain control can have an amplifier and a light bulb with a filament. The amplifier can amplify the analog signal and provide a drive signal for the light bulb. The drive signal induces a drive current to flow through the filament. The analog signal is responsive to an input signal.

The automatic gain control can include a gain controlled amplifier and a controller. The controller can convert the analog signal into a control signal. The gain controlled amplifier can receive the control signal to control the signal gain of the gain controlled amplifier.

An alternative embodiment is disclosed of a personal microphone that receives a phantom DC voltage and provides a processed output signal having a dynamic range. This embodiment of a personal microphone includes a microphone output connector that receives the phantom DC voltage and provides the processed output signal, a structure with a form factor for live performance, a capsule for converting acoustic energy into an input signal, and an adjustable signal processor located in the structure for converting the input signal into the processed output signal. The adjustable signal processor includes a dynamic range compressor to compress the processed output signal. The microphone output connector can have pins arranged in a compatible pattern for coupling to a 3-pin female XLR connector. The adjustable signal processor includes signal input terminals, input/output terminals, and an adjustment device. The signal input terminals receive the input signal from the capsule. The input/output terminals receive the phantom DC voltage from the microphone output connector and provide the processed output signal to the microphone output connector. The adjustment device adjusts the operating parameters of the adjustable signal processor.

The personal microphone can have a security device to avoid unwanted changes to the operating parameters. The security device can include an access screw and an access hole in the structure. The access screw can be unscrewed to open the security device, and the adjustable signal processor can be removed from the structure through the access hole to access the adjustment device in order to adjust the operating parameters.

The adjustment device can include a potentiometer having an actuator. The actuator can be adjusted to change the resistance of the potentiometer and the operating parameters.

The dynamic range compressor can have an automatic gain control for changing signal gain in response to an analog signal derived from or the same as the input signal. The automatic gain control can include a light bulb having a filament; and an amplifier for providing a drive signal for the light bulb, such that the drive signal induces a drive current to flow through the filament.

The automatic gain control can include a gain controlled amplifier and a controller. The controller can convert the analog signal into a control signal. The gain controlled amplifier can receive the control signal to control the signal gain of the gain controlled amplifier.

A microphone is disclosed. The microphone has a body with a proximal end and a distal end, an input end located at the proximal end, an output end located at the distal end, a windscreen located at the input, a capsule, an adjustable locating device and a microphone output connector. The capsule is located at the input end behind the windscreen, and converts acoustic energy into an input signal. The adjustable locating device changes the location of the capsule relative to the windscreen. The microphone output connector provides the output signal which is responsive to the input signal and has a dynamic range. The microphone output connector can have pins arranged in a compatible pattern for coupling to a 3-pin female XLR connector. The capsule includes a proximity effect to provide a bass boost in the output signal. Adjusting the location of the capsule relative to the windscreen using the adjustable locating device changes the bass boost caused by the proximity effect.

The adjustable locating device can include a removable ring located between the body and the windscreen. The removable ring can be installed or removed. When installed, the removable ring locates the capsule farther from a person's mouth (or other sound source) and decreases the bass boost. When removed, the removable ring locates the capsule closer to the person's mouth and increases the bass boost.

The adjustable locating device can include a capsule locating device and a lock device. The capsule can protrude a predetermined protrusion distance relative to the input end of the body toward the front of the windscreen. The capsule locating device can move the capsule to change the protrusion distance and the bass boost. The lock device can prevent unintentional movement of the capsule relative to the front of the windscreen.

The microphone can include a dynamic range compressor located in the body to compress the dynamic range of the output signal.

DETAILED DESCRIPTION OF EXEMPLARY EMBODIMENTS

Figure 1:
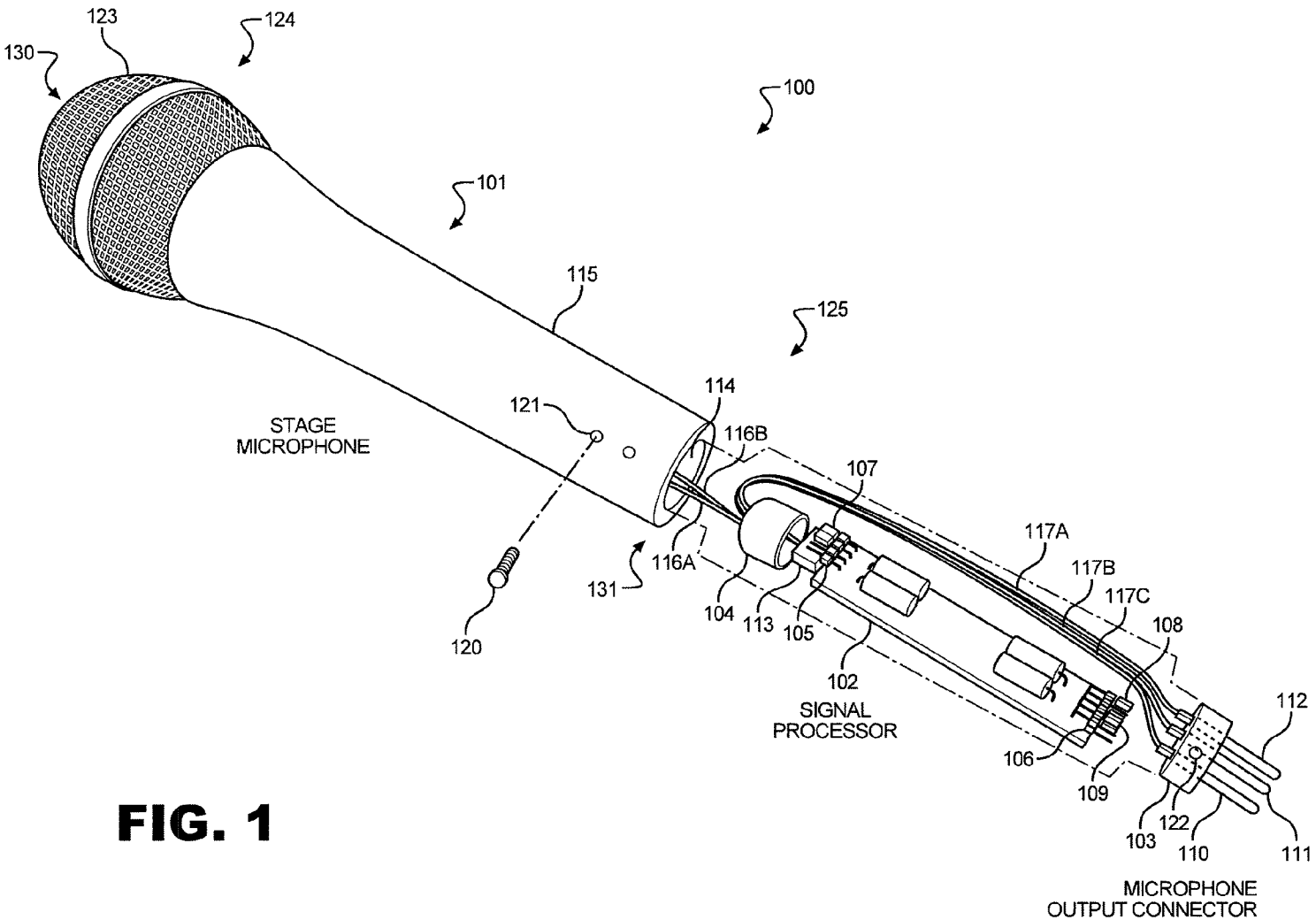
FIG. 1 is an exploded view of an embodiment of a personal microphone having a programmable signal processor.

FIG. 1 shows an embodiment of a personal microphone 101 having a structure 100 that facilitates a live performance. The structure 100 has a stage-microphone form factor which includes a body 115 having a proximal end 130 and a distal end 131. An input end 124 is located at the proximal 130 and an output end 125 is located at the distal end 131. A windscreen 123 and a capsule 150 (shown in FIG. 2) are located at the input end 124. The capsule 150 is located behind the windscreen 123. A microphone output connector 103 is located at the output end 125. The output connector 103 is a 3-pin male XLR connector or another kind of connector having two or three pins arranged in a compatible pattern for coupling to a 3-pin female XLR connector. In the embodiment where the connector 103 has two pins, the compatible pattern pin arrangement is linear. The pins are located at two points along an imaginary straight line. In the embodiment where the connector 103 has three pins, the pin arrangement is triangular. The pins are located at three points of an imaginary triangle.

The microphone 101 includes a programmable signal processor 102 located in the body 115. The processor 102 and the output connector 103 are inserted into the body 115 through an access hole 114 at the output end 125. The processor 102 and the output connector 103 are located inside voids 151, 152 respectively. An access screw 120 can be inserted through a screw hole 121 in the body 115 to engage a threaded hole 122 in the output connector 103 to fasten the output connector 103 in the body 115.

Connections between the processor 102, the microphone 101, and the output connector 103 are via a programming-input/output header 105 and a multi-pin connector 113. In this embodiment, the multi-pin connector 113 has five contacts. The capsule 150 is coupled to the processor 102 through the multi-pin connector 113 via wires 116A, 116B. The output connector 103 is coupled to the processor 102 through the multi-pin connector 113 via wires 117A, 117B and 117C. An insulator cap 104 can be installed over the connector 113. The processor 102 can be covered with an insulator such as electrical tape or conformal coating (not shown) before being inserted into the access hole 114.

Figure 2:
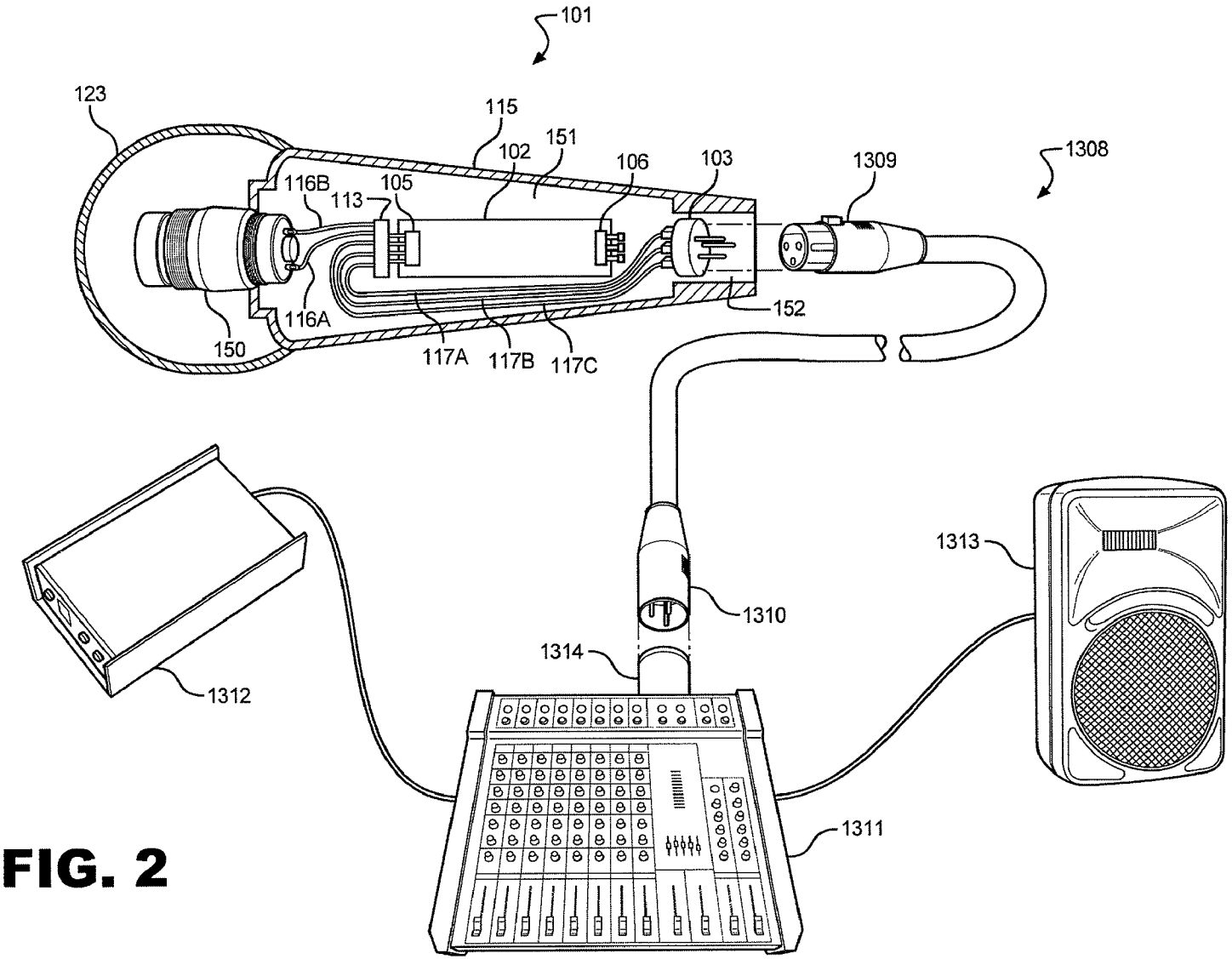
FIG. 2 is a cut-away view of a personal microphone connected to a mixing console having a phantom power supply and a loudspeaker.

FIG. 2 shows the microphone 101 with a mixing console 1311 and a microphone cable 1308. The mixer 1311 has a 3-pin female XLR input connector 1314. The microphone cable 1308 has a 3-pin female XLR connector 1309 and a 3-pin male XLR connector 1310. The mixing console 1311 has a phantom power supply 1312 and a loudspeaker 1313. The mixing console 1311 and the power supply 1312 may be in separate enclosures as shown or they may share a common enclosure.

In operation the phantom power supply 1312 provides a phantom DC voltage to the processor 102 via the mixer 1311, the microphone cable 1308, and the output connector 103. Acoustic energy (sound) passes through the windscreen 123. The capsule 150 receives the sound and provides an input signal. The processor 102 processes the input signal to provide a processed output signal to the mixer 1311 via the output connector 103 and the microphone cable 1308.

Figure 4:
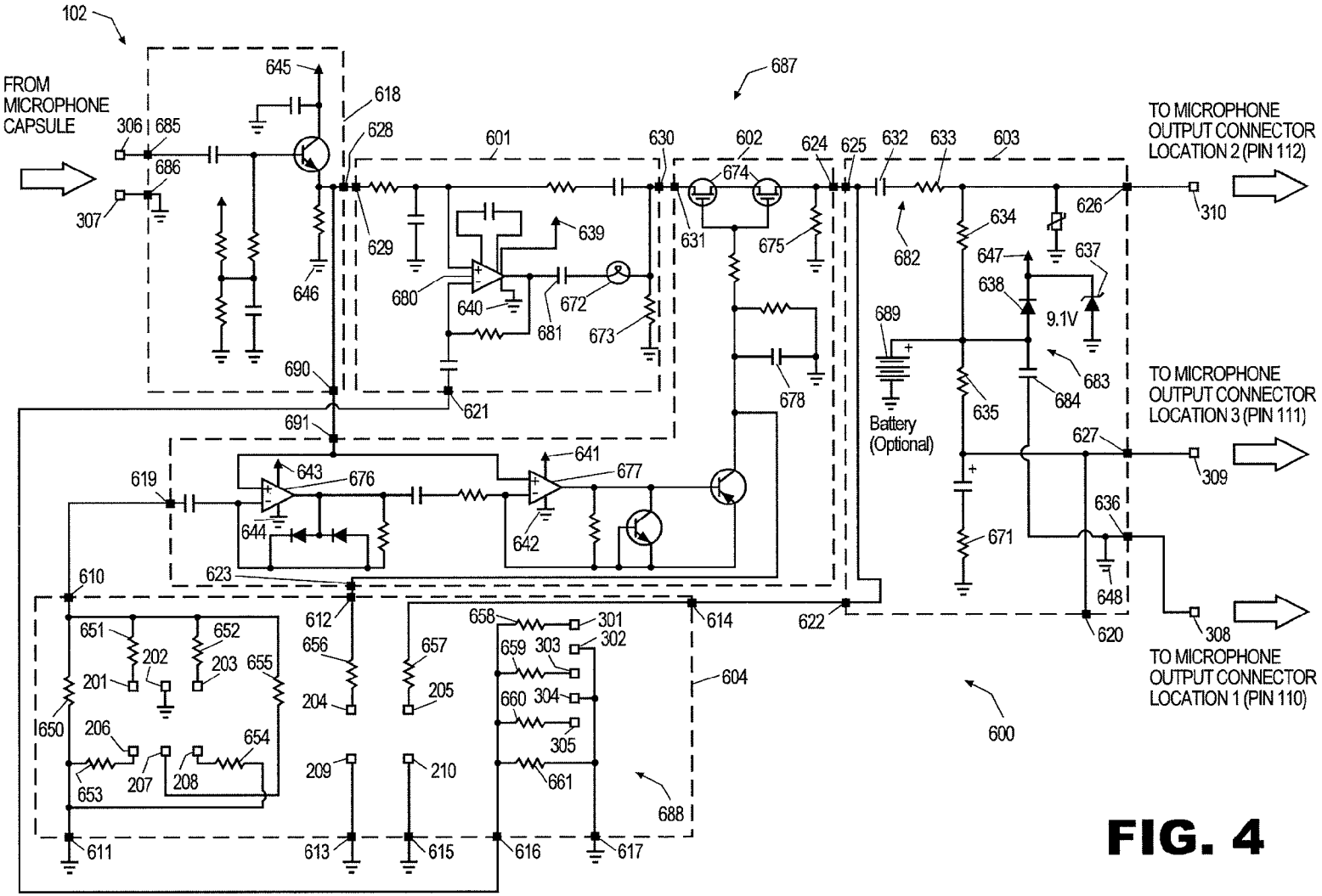
FIG. 4 is a schematic diagram of a programmable signal processor having a programming device and a bidirectional output device.

FIG. 4 shows an embodiment of the processor 102 that includes input posts 306, 307 coupled to signal input terminals 685, 686, and input/output posts 308, 309, 310 coupled to input/output terminals 626, 627, 636. The input signal is coupled from the capsule 150 to the input posts 306, 307 via the wires 116B, 116A and the connector 113. The output posts 308, 309, 310 are coupled respectively to the output connector 103 pins 110, 111, 112 via the wires 117C, 117B, 117A and the connector 113. These connections couple the phantom DC voltage from the output connector 103 to the signal processor 102. These connections also couple the processed output signal from the input/output terminals 626, 636 of the processor 102 to the pins 110, 112 of the output connector 103, where pin 112 has the processed output signal and pin 110 has a ground (a reference potential).

FIG. 1 shows the output connector 103 having three terminals: a positive pin 112 for receiving the processed output signal from the processor 102, a ground pin 110 having the ground, and a return pin 111. The return pin 111 and the positive pin 112 receive the phantom DC voltage from the phantom power supply 1312 while the ground pin 110 receives the ground from the phantom power supply 1312. In XLR connectors, each pin or socket has a pin-number which designates the pin or socket location on the connector. For the output connector 103, the ground pin 110 is pin number 1 at location 1, the positive pin 112 is pin number 2 at location 2, and the return pin 111 is pin number 3 at location 3. For 3-pin female XLR connectors, the locations 1, 2, 3 are a mirror image of the male XLR connector locations and each location of the female connector has a female socket for coupling to a male pin. In reference to its original manufacturer, James H. Cannon, founder of Cannon Electric in Los Angeles, Calif., the connector is colloquially known as a cannon plug or cannon connector. Originally the Cannon X series, subsequent versions added a Latch "Cannon XL" and then a Rubber compound surrounding the contacts, which led to the abbreviation XLR. Many companies now make XLRs. XLR connectors are not typically made with the Rubber compound. Nevertheless, the "R" is included in the acronym "XLR" when referring to these connectors regardless of whether or not the Rubber compound is included. Furthermore, even though it has sockets instead of pins, a 3-socket female XLR connector is typically referred to as a 3-pin female XLR connector.

Figure 3:
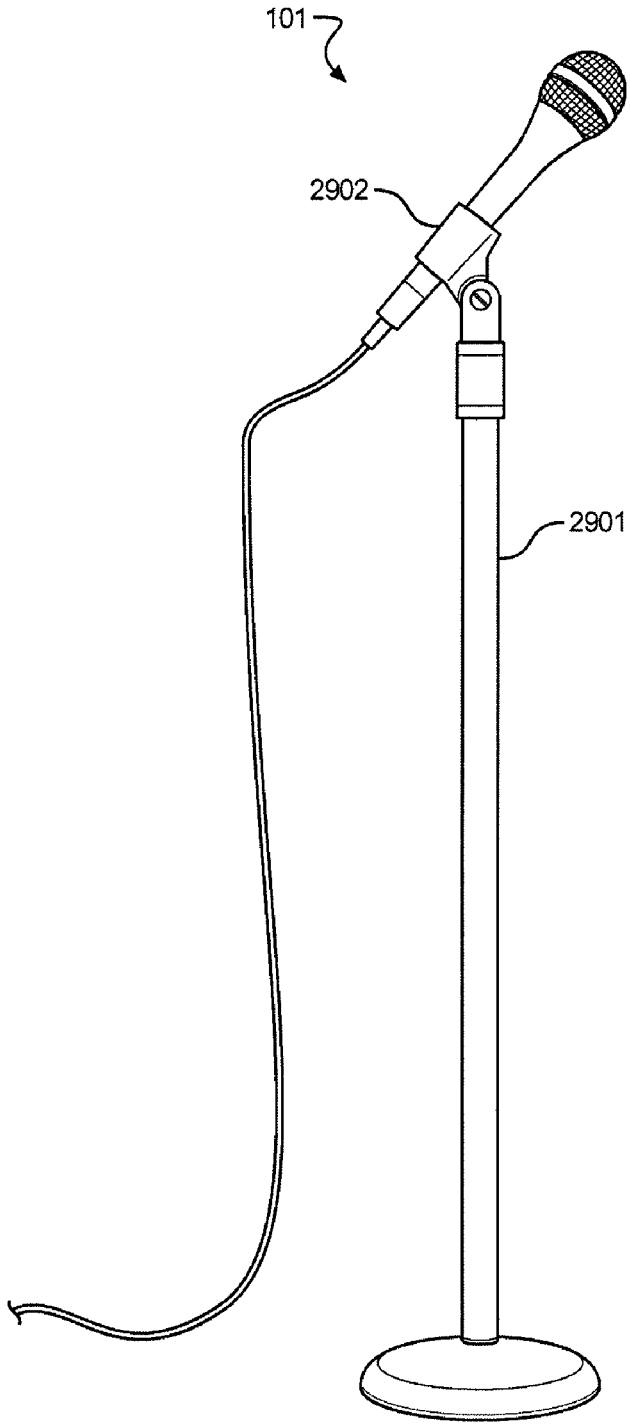
FIG. 3 is a drawing of a microphone clip and stand supporting a personal microphone.

The stage-microphone form factor 100 has various support devices for supporting the microphone 101 while in operation. One support device is the performer's hand. The body 115 can have diameters ranging from 16 mm to 45 mm to fit comfortably in the hand. FIG. 3 shows another support device comprising a microphone clip 2902 that connects the stage microphone 101 to a microphone stand 2901.

FIG. 4 shows a schematic 600 of an embodiment of the programmable signal processor 102 having a signal processor 687, a bidirectional output device 603 and a programming device 604. The processor 687 includes a preamplifier 618, a dynamic range compressor 601, and a noise-gate 602. The preamplifier 618 receives the input signal at signal input terminals 685, 686 and produces an analog signal at terminals 628, 690. A compressor input terminal 629 receives the analog signal. A compressor output terminal 630 provides a compressor output signal which is coupled to a noise gate input terminal 631. A noise-gate output terminal 624 provides a processor output signal which is coupled to an output-device input terminal 625. The analog signal is coupled to a noise-gate input terminal 691. The analog signal is derived from the input signal. In this embodiment the analog signal has virtually the same signal level and phase as the input signal. In another embodiment preamplifier 618 may change the signal level, phase response, time delay, transient response, the frequency response and/or other aspects of the analog signal relative to the input signal. In another embodiment, the preamplifier 618 can be deleted and the input signal coupled directly to the compressor 601 and the noise-gate 602 so that the input signal and the analog signal can be the same signal.

The processor 687 produces the processor output signal at the noise-gate output terminal 624 but the noise-gate 602 is optional. When the noise-gate 602 is omitted, the terminal 630 can provide the processor output signal and the terminal 630 can be connected directly to the output-device input terminal 625 so that the compressor output signal and the processor output signal can be the same signal.

The dynamic range compressor 601 has decreased gain when the average input signal level is above a predetermined compression threshold. The noise-gate 602 has decreased gain when the average input signal level is below a predetermined noise-gate threshold. When the average input signal level is increased from zero, the noise-gate threshold is crossed first before the compression threshold is crossed.

The compressor 601 and the noise-gate 602 each have an automatic gain control for changing signal gain in response to the analog signal. The automatic gain control of the compressor 601 includes a lamp 672 which can be a light bulb with a tungsten filament. The automatic gain control of the noise-gate 602 includes a pair of MOSFET transistors 674. The absolute value of the gain of the compressor 601 and/or the noise-gate 602 may be less than 1 or greater than 1 depending on the predetermined values of electrical components and the average level of the input signal.

An operational amplifier 680 amplifies the analog signal to provide a drive signal. The drive signal is coupled to the lamp 672 by a coupling capacitor 681. The drive signal induces a drive current to flow through and heat the lamp 672 filament. The greater the input signal, the greater the drive current. The lamp 672 filament can be made of tungsten which has a positive temperature coefficient of resistance. The temperature and resistance of the filament increase when the average level of the input signal increases above the compression threshold. The compression threshold is determined by the filament diameter, length, and other factors.

The filament is considered cold when the input signal is below the compression threshold. The filament is considered hot and may produce visible light when the input signal is above the compression threshold. The compression threshold relative to the input signal is a soft-knee threshold that begins at about 15 dB below the visible light threshold of the filament and ends at about 2 dB above the visible light threshold.

The lamp 672 forms a voltage divider with a resistor 673. The voltage divider receives the drive signal and provides a divided drive signal which is referenced across the terminals of the resistor 673. The greater the input signal, the greater the filament resistance and the more attenuated the divided drive signal. The divided drive signal is coupled to the compressor output terminal 630 to provide the compressor output signal. The divided drive signal is a representation of the input signal with a decreased dynamic range. The filament produces visible light when the drive current is between about 6.5 milliamperes to about 13 milliamperes, and the filament voltage (referenced across the lamp terminals) is between about 0.5 volts and about 2.5 volts. The filament can be connected between and supported by two filament supports that are spaced apart. A left end of the filament can contact a left filament support at a left contact location. A right end of the filament can contact a right filament support at a right contact location. A distance of less than about 3 millimeter can be between the left contact location and the right contact location to separate the left contact location from the right contact location.

The dynamic range compressor 601 can be referred to as an audio limiter when a higher compression ratio is provided. Typically a dynamic range compressor having a compression ratio of about 10:1 or greater can be referred to as a limiter or a leveling amplifier while a dynamic range compressor having a lesser compression ratio can be referred to as a dynamic range compressor or a compressor.

The dynamic range compressor 601 may not have a lamp. In another exemplary embodiment the compressor 601 can have an automatic gain control comprising a gain controlled amplifier. The gain controlled amplifier may be a voltage controlled amplifier (VCA), a transconductance amplifier, or another kind of amplifier having a controllable gain. The gain controlled amplifier receives a control signal from a controller. The controller receives the analog signal and creates the control signal. The control signal is responsive to the input signal and can represent the signal level of the input signal. The control signal controls the gain of the VCA to compress the processed output signal. Whether the automatic gain control includes a lamp, a VCA, or another kind of device, the signal gain of the automatic gain control can be greater than one or less than one depending on the input signal level, the signal processor operating parameters, compressor performance objectives, and/or other factors.

The compressor 601 can limit the processed output signal to avoid overloading amplifiers, mixing consoles, and loudspeakers. The result for a performer or singer can be added strength for softer passages in the more difficult-to-project lower vocal range without an excessive level of the processed output signal in higher intensity passages. When the performer is part of an ensemble, the compression may avoid overpowering other instruments or performers.

In the noise-gate 602, the MOSFET transistors 674 have a channel resistance which is in a voltage divider with a resistor 675. The channel resistance is changed by the MOSFET gate voltage applied by an AC/DC converter comprising a pair of op-amps 676, 677, a filter capacitor 678 and other components. When the average level of the input signal falls below the noise-gate threshold, the AC/DC converter decreases the gate voltage to increase the channel resistance. The noise-gate 602 can reject low level signals from the processed output signal. This includes feedback signals which may begin at a low level and increase. If however, feedback still occurs, the compressor 601 can limit the volume of the processed output signal to make the feedback less severe.

The compressor 601 and the noise-gate 602 are dynamic range processors that make the dynamic range of the processed output signal different than the dynamic range of the input signal. The compressor 601 decreases the dynamic range of the processed output signal relative to the input signal by making loud sounds quieter and quiet sounds louder. Loud sounds correspond to an average level of input signal above the compression threshold. Quiet sounds correspond to an average level of input signal below the compression threshold.

The noise-gate 602 increases the dynamic range of the processed output signal relative to the input signal by reducing background noise. Background noise corresponds to an average level of input signal below the noise-gate threshold.

The operating parameters of the processor 102 include the compression threshold, the noise-gate threshold, a release time of the noise-gate 602, and an output volume of the processed output signal. The compression threshold is set by the resistance between a compression threshold terminal 621 and ground. The noise-gate threshold is set by the resistance between a noise-gate control terminal 619 and ground. Lesser resistance sets lower thresholds. The release time is set by the resistance between a release time control terminal 623 and ground. Lesser resistance sets a shorter release time (faster release). The output volume is set by the resistance between a volume control terminal 622 and ground. Lesser resistance sets lower output volume.

FIG. 4 shows a schematic diagram of an embodiment of the programming device 604 having posts 301-305 for setting the compression threshold of the compressor 601; posts 201, 202, 203, 206, 207, 208 for setting the noise-gate threshold of the noise-gate 602; posts 204, 209 for setting the release time of the noise gate 602; and posts 205,210 for setting the output volume of the processed output signal.

Figure 6:
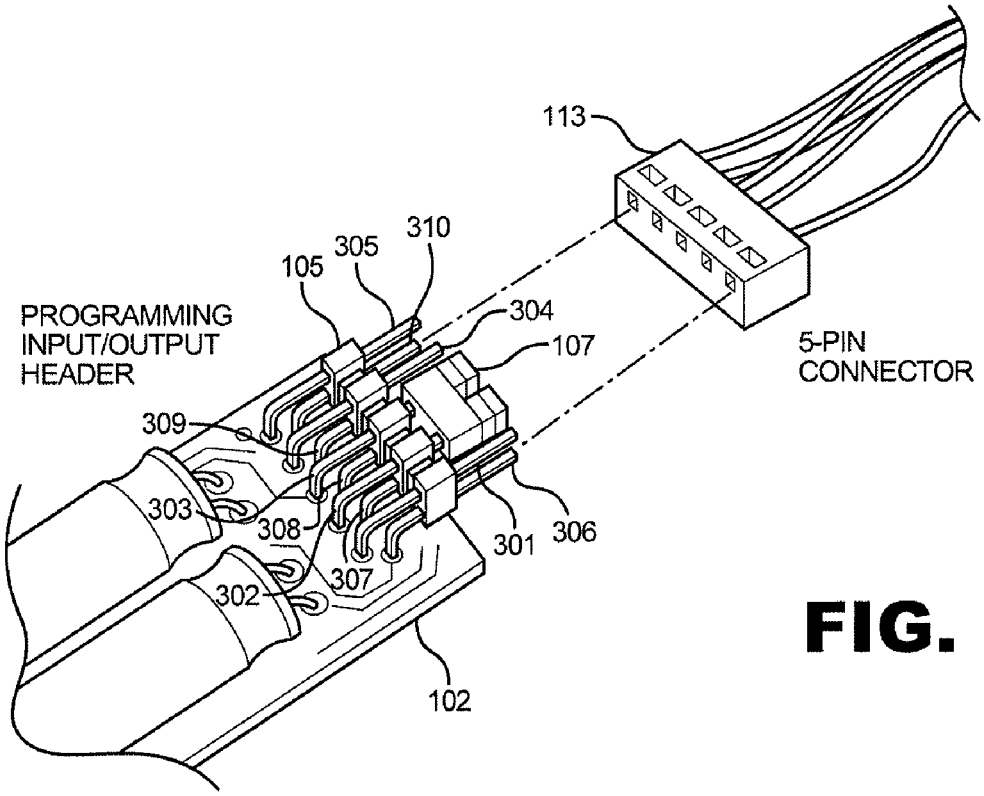
FIG. 6 is a another perspective view of a programming device having a programming input/output header with shunts in exemplary positions.

FIG. 6 shows an embodiment of the programming-input/output header 105 having a top row of posts 301-305 and a bottom row of posts 306-310. The bottom row of posts 306-310 are dedicated to connecting with the connector 113. The top row of posts 301-305 are dedicated to setting operating parameters. For example, FIG. 6 shows a shunt 107 pushed onto the pair of posts 302,303. Each shunt creates a short circuit between a pair of posts. Each shunt is a relocatable switch that can be moved from one pair of posts to another. Each short circuit contributes to setting the operating parameters by changing a resistive load on a control terminal. The header 105 is shared by the shunts, which may be located on the top row of posts, and the connector 113 which is connected to the bottom row of posts.

Figure 5:
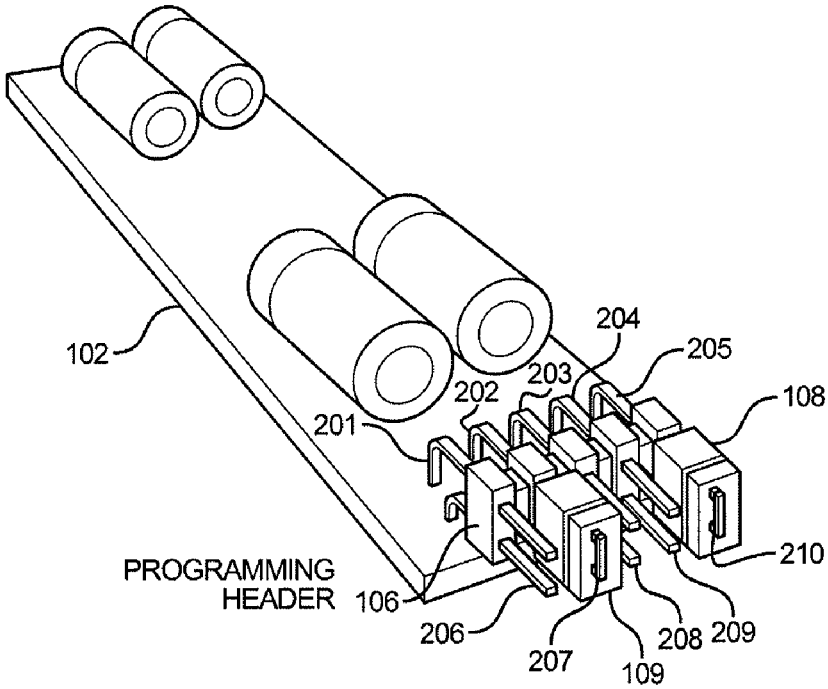
FIG. 5 is a perspective view of a programming device having a programming header with shunts in exemplary positions for programming operating parameters of a programmable signal processor.

FIG. 5 shows an embodiment of a programming header 106 having a top row of posts 201-205 and a bottom row of posts 206-210 that are used to set operating parameters. A shunt 108 is pushed onto the pairs of posts 205, 210; and a shunt 109 is pushed onto the pair of posts 202, 207.

The shunts 107, 108, 109 remain in place while the microphone 101 is in operation. The shunts 107, 108, 109 and the headers 105, 106 are components of a nonvolatile memory device 688 which stores information about the processor 102 operating parameters. The information is stored as a pattern (or a combination) of shunts and post pairs.

The programming device 604 retrieves the operating parameters from the memory device 688 by way of the short circuits between post pairs making predetermined parallel and/or series combinations of fixed resistors 650-661 to produce resistive loads. The programming device 604 sets the operating parameters by the resistive loads affecting the signal processor 102 via the control terminals 621, 619, 623, 622. The control terminals 621, 619, 623, 622 are coupled respectively to programming terminals 616, 610, 612, 614 of the programming device 604. The programming device 604 has switchable resistor networks coupled between the programming terminals and ground terminals. A noise-gate threshold switchable resistor network coupled between programming terminal 610 and ground terminal 611 comprises resistors 650, 651, 652, 653, 654, 655 and posts 201, 202, 203, 206, 207, 208. A noise-gate release time switchable resistor network coupled between programming terminals 612 and ground terminal 613 comprises resistor 656 and posts 204, 209. A volume control switchable resistor network coupled between programming terminals 614 and ground terminal 615 comprises resistor 657 and posts 205, 210. A compression threshold switchable resistor network coupled between programming terminals 616 and ground terminal 617 comprises resistors 658, 659, 660, 661 and posts 301, 302, 303, 304, 305.

The processed output signal is derived from the processor output signal. Referring back to FIG. 4, the output device 603 has a combining device 682 which includes a blocking capacitor 632 and resistors 633, 634, 635. The combining device 682 combines the processor output signal, which can be an AC voltage from terminal 625, with the phantom DC voltage, which is a DC voltage from terminals 626, 627. The signals resulting from the output device 603 processing can be as follows. The terminal 626, the post 310 and the pin 112 (location 2) of the output connector 103 can have the phantom DC voltage plus the processed output signal. The terminal 627, the post 309, and the pin 111 (location 3) can have the phantom DC voltage. The terminal 636, the post 308, and the pin 110 (location 1) can have a ground which is the reference potential for all the resulting signals. In another embodiment, terminal 627 and pin 111 (location 3) of the connector 103 can be omitted or used for another purpose. Less power may be delivered by the phantom power supply 1312 because resistor 635 does not carry current from the phantom power supply 1312. The output device 603 may include other circuits or devices to modify the processed output signal. In another embodiment, terminal 627 can optionally have a phase-inverted processed output signal in addition to the phantom DC voltage. The phase-inverted processed output signal can be provided by an inverting amplifier. The input of the inverting amplifier can be coupled to the terminal 625 and the lower connection of a resistor 671 can be disconnected from ground and coupled to the output of the inverting amplifier. Alternatively, the phase-inverted processed output signal can be provided by a transformer in place of or in addition to the inverting amplifier. The processed output signal can also be provided by the transformer. The output device 603 can include filters and/or other devices to process or modify the processed output signal.

The output device 603 has a regulator device 683 which includes resistor 634, resistor 635, a filter capacitor 684, a Zener diode 637, and a blocking diode 638. The regulator device 683 separates the phantom DC voltage from the processed output signal and provides a power supply DC voltage to processor 102. The Zener diode 637 and the blocking diode 638 regulate the power supply DC voltage to a regulated DC voltage of about 9.1 volts and prevent an accidental polarity reversal of the regulated DC voltage. Terminals 647,648 apply the regulated DC voltage and the ground to the signal processor 102 via power input terminals 639-646 and other power input terminals. The positive power input terminals 639, 641, 643, 645 receive the regulated DC voltage from the supply voltage terminal 647. The negative power input terminals 640, 642, 644, 646 receive the ground from the ground terminal 648.

Figure 7:
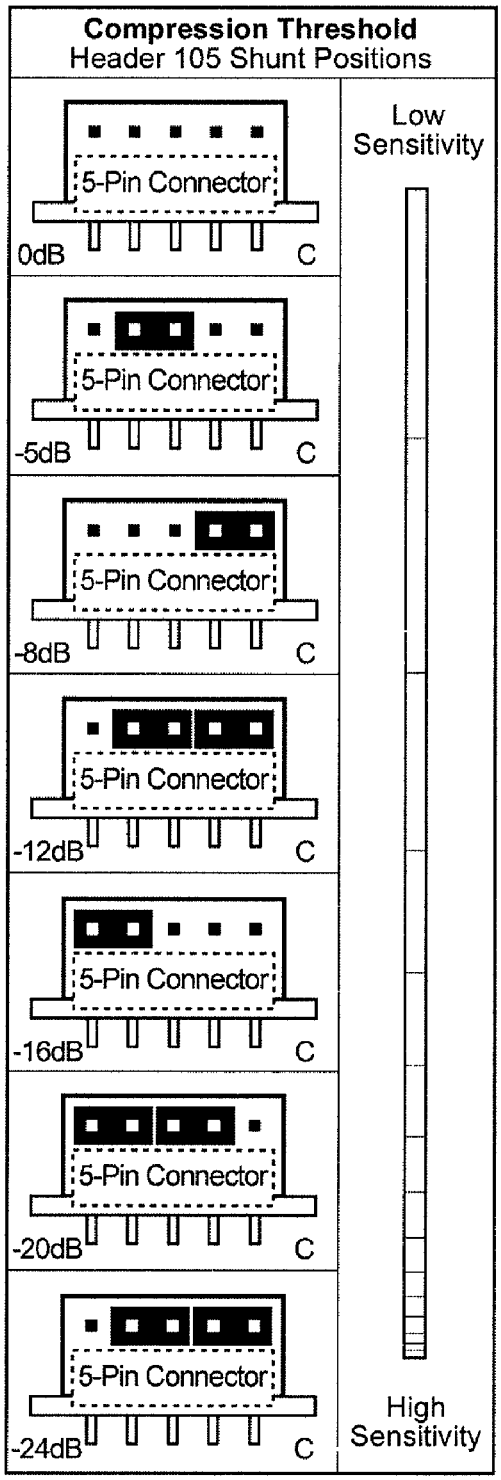
FIG. 7 is a table of exemplary operating parameters of a dynamic range compressor of a programmable signal processor.

FIG. 7 shows exemplary programming configurations for the programming-input/output header 105. The header 105 and its shunts store information about the compression threshold operating parameter. The configurations shown in FIG. 7 range from no shunts and a 0 dB compression threshold (top program) to two shunts and a −24 dB compression threshold (bottom program). The top program provides Low Sensitivity to incoming sounds because it has a higher compression threshold of 0 dB. The bottom program provides High Sensitivity to incoming sounds because it has a lower compression threshold of −24 dB. The top program shows that no shunts are located on the posts 301, 302, 303, 304, 305 which are represented respectively from left to right by five black squares arranged in a row. Below the posts 301-305 is the multi-pin connector 113 which is represented as a broken-line rectangle enclosing the words "5-Pin Connector". The bottom program shows that two shunts are used. Each shunt is represented by a black rectangle having two smaller white squares. The first shunt shorts post 302, 303 and the second shunt shorts post 304, 305.

Figure 8:
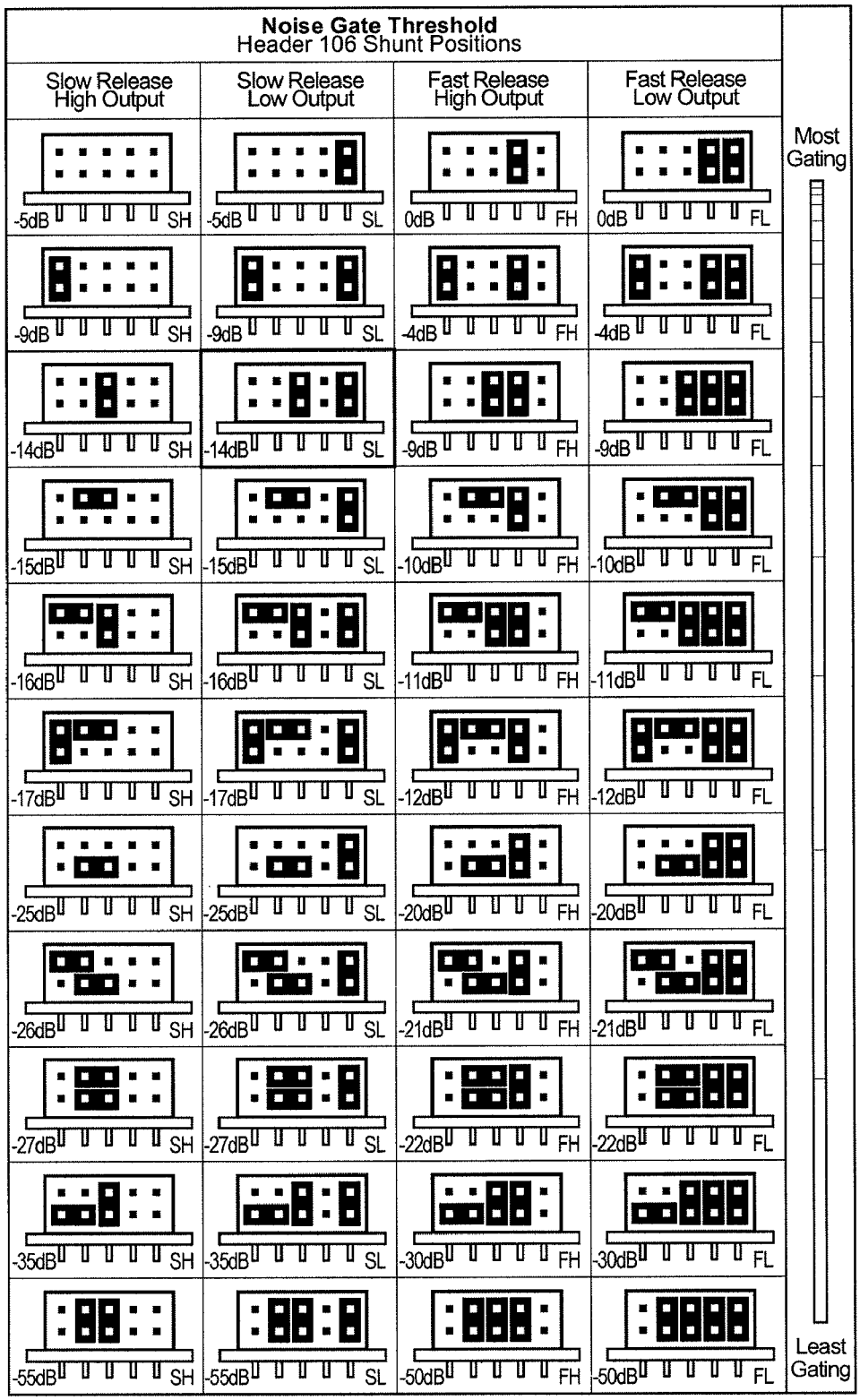
FIG. 8 is a table of exemplary operating parameters of a noise gate of a programmable signal processor.

FIG. 8 shows exemplary programming configurations for the programming header 106. The header 106 and its shunts store information about the operating parameters for the noise-gate threshold, the noise gate release time, and the output volume. The configurations shown in FIG. 8 use zero to four shunts that provide a noise-gate threshold ranging from 0 dB to −55 dB with a slow or fast release time, and a low or high output volume. An example is the second column, third row which shows a configuration using two shunts that provide a −14 dB noise-gate threshold, and a slow release time with a low output volume (designated by "SL"). The top row of five black squares in each programming configuration represent post 201, 202, 203, 204, 205 respectively from left to right. The bottom row of five black squares represent post 206, 207, 208, 209, 210 respectively from left to right. The top row of four programming configurations provide the Most Gating because in these programs the signal gain of the AC/DC converter is decreased to decrease the sensitivity of the noise-gate 602 to incoming sounds. The bottom row of four programming configurations provide the Least Gating because in these programs the signal gain of the AC/DC converter is increased to increase the sensitivity of the noise-gate 602 to incoming sounds.

The connector 113 and the header 105 enable the processor 102 to be separated from the microphone body 115. The shunts, posts and headers may be easier to manipulate when the processor 102 is detached from the microphone body 115.

FIG. 1 shows that the headers and shunts are accessible by partially disassembling the microphone 101. The user can remove the screw 120 and pull the connector 103 and the processor 102 out of the body 115 through the access hole 114. Needle-nose pliers can be used to pull out the connector 103 and the processor 102. Alternatively, the windscreen 123 and the capsule 150 can be removed from the body 115 leaving an access hole in the proximal end 130 through which the processor 102 can be removed from the body 115. The following 3 paragraphs describe a procedure for storing operating parameter information in the memory device 688 by installing or removing shunts.

Figure 9:
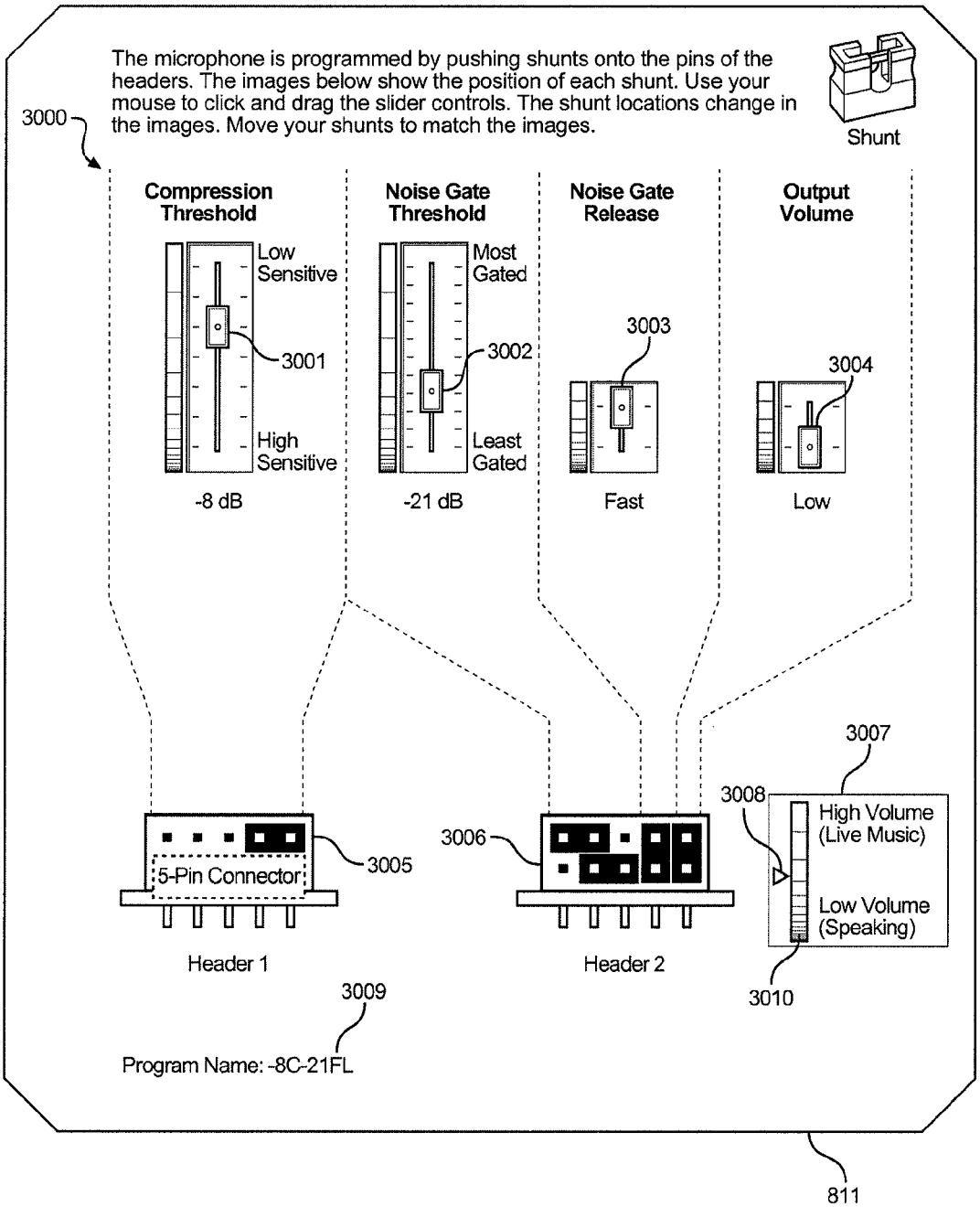
FIG. 9 is a drawing of a computer program user interface for selecting operating parameters and displaying shunt locations.

FIG. 9 shows an embodiment of a user interface 3000 which can be displayed by a computer program on a display monitor. An exemplary embodiment of the program is written in a JavaScript language and runs in an HTML document loaded into a web browser on a personal computer. The user interface 3000 includes virtual slider controls 3001-3004; virtual header representations 3005, 3006 of headers 105, 106 respectively; and a summary display 3007.

In operation, a person uses the personal computer to browse the Internet and click on a link to load a webpage containing the user interface 3000. Using a pointing device (not shown), the person clicks and drags (virtually moves) the slider controls 3001-3004. The pointing device can be a mouse or other device for moving the computer cursor. As the controls 3001-3004 are moved, the virtual headers 3005, 3006 change to show the shunt locations on each of the headers 105, 106. The virtual headers 3005, 3006 change programming configurations as the controls 3001-3004 are moved. Examples of the programming configurations are shown in FIGS. 7 and 8. The person sets the operating parameters of the processor 102 by moving the shunts on the headers 105, 106 of the microphone 101 to match the virtual headers 3005, 3006 shown by the user interface 3000.

The user interface includes an indicator arrow 3008 in the summary display 3007 which moves up or down along a volume indicator scale 3010 when the controls 3001-3004 are moved. The indicator 3008 shows whether the operating parameters are for High Volume use (as in live music for example) or Low Volume use (as in speaking for example). The user interface can include a program name display 3009 that changes when the controls 3001-3004 are moved to show a program name for the operating parameters of each programming configuration. In the example program name shown as −8C−21FL: the −8C represents −8 dB compression threshold; the −21 represents noise-gate threshold; the F represents Fast noise-gate release time; and the L represents Low output volume.

Below each virtual slider control is a display of the slider's current setting. In the example given, the compression threshold slider control 3001 is set to −8 dB. Sliding the control 3001 upward from the position shown changes the display to a greater number such as −5 dB or 0 dB. The noise-gate threshold slider control 3002 is set to −21 dB. Sliding the control 3002 upward from the position shown changes the display to a greater number such as −20 dB or −12 dB. The noise-gate release time slider control 3003 is set to Fast. (Fast is represented by an F in FIG. 8.) Sliding the control 3003 downward from the position shown changes the display to Slow. (Slow is represented by an S in FIG. 8.) The output volume slider control 3004 is set to Low. (Low is represented by an L in FIG. 8.) Sliding the control 3004 upward from the position shown changes the display to High. (High is represented by an H in FIG. 8.)

Figure 10:
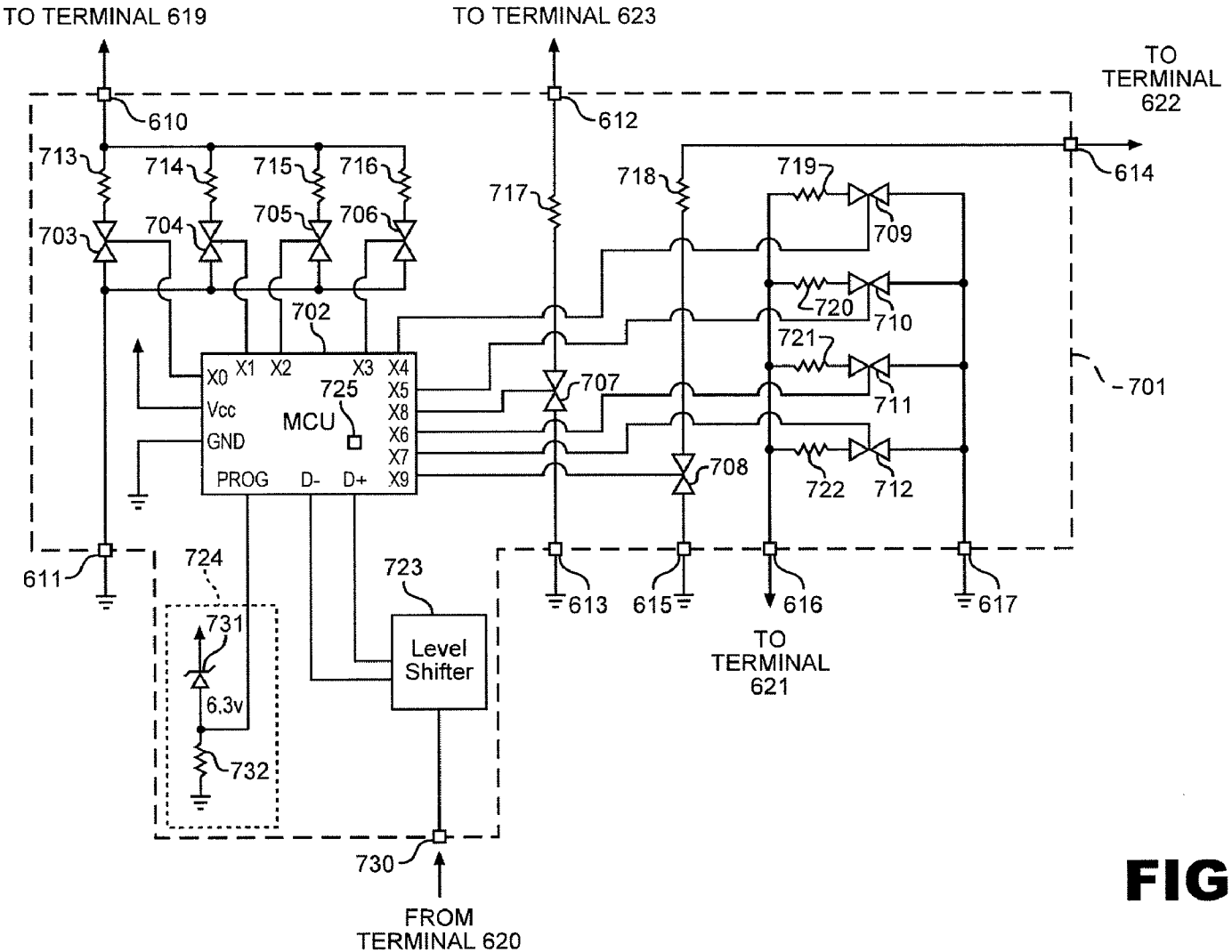
FIG. 10 is a schematic diagram of an alternative embodiment of a programming device.

FIG. 10 shows a schematic of a digital programming device 701 that can be used as an alternative to the programming device 604 of FIG. 4. The digital device 701 includes analog switches 703-712, fixed resistors 713-722, a microcontroller 702, a level shifter 723, an initiator 724, and a data terminal 730. The initiator 724 includes a lower voltage Zener diode 731 (6.3 volts in this embodiment) and a resistor 732. The microcontroller 702 has a PROGRAMMING mode of operation and a RUN mode of operation. A noise-gate threshold switchable resistor network coupled between programming terminal 610 and ground terminal 611 comprises resistors 713, 714, 715, 716 and analog switches 703, 704, 705, 706 controlled by the microcontroller 702. A noise-gate release time switchable resistor network coupled between programming terminal 612 and ground terminal 613 comprises resistor 717 and analog switch 707 controlled by the microcontroller 702. A volume control switchable resistor network coupled between programming terminal 614 and ground terminal 615 comprises resistor 718 and analog switch 708 controlled by the microcontroller 702. A compression threshold switchable resistor network coupled between programming terminal 616 and ground terminal 617 comprises resistors 719, 720, 721, 722 and analog switches 709, 710, 711, 712 controlled by the microcontroller 702.

Figure 11:
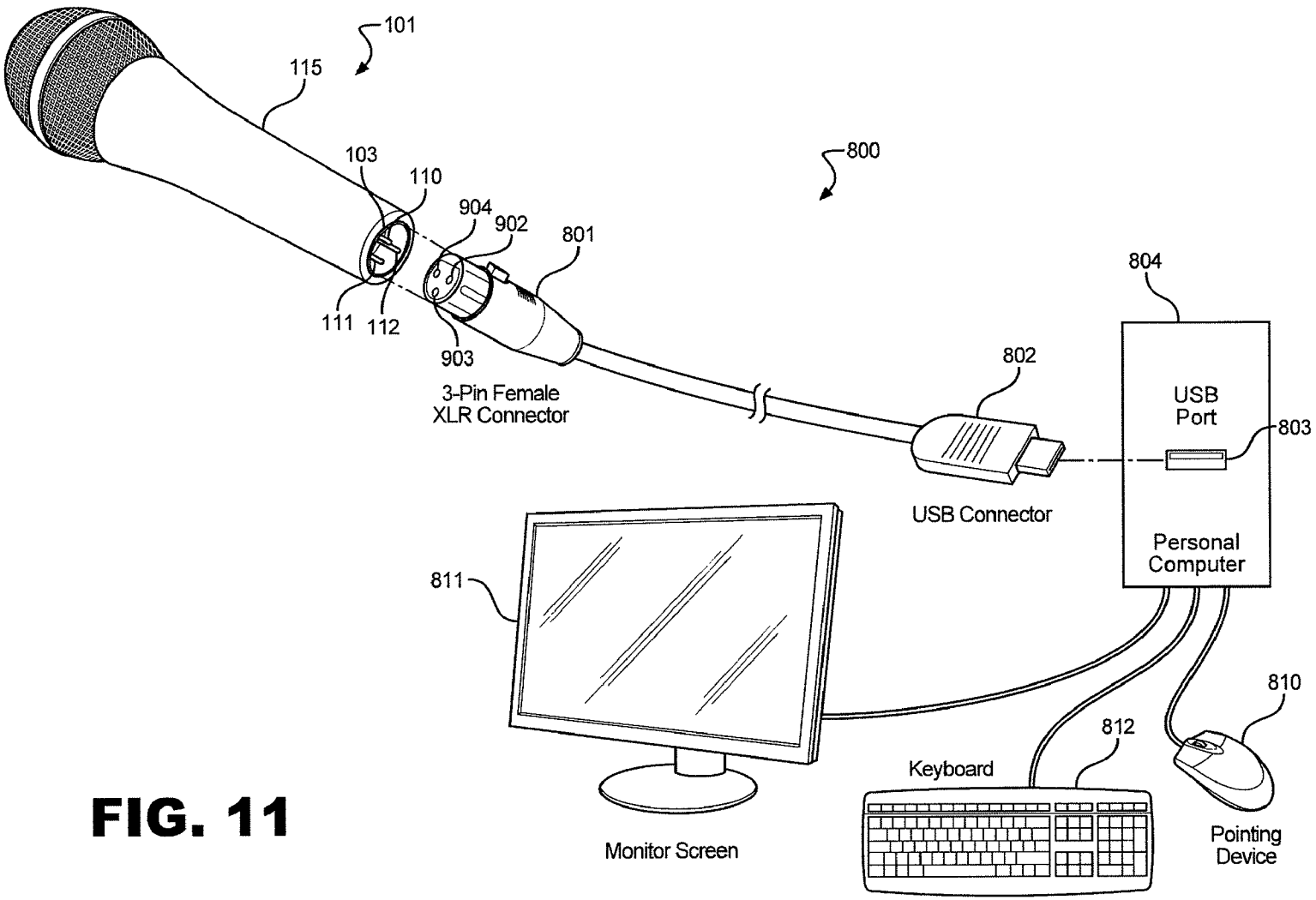
FIG. 11 is a drawing of a personal microphone coupled to a personal computer via a programming adaptor for programming operating parameters.

The PROGRAMMING mode can be initiated by connecting a programming adaptor 800 between the output connector 103 of the microphone 101 and a computer port 803 (such as a USB port for example) of a personal computer 804, as shown in FIG. 11. The port 803 can be a universal serial bus (USB) port or another kind of computer port. The programming adaptor 800 includes a female XLR connector 801, a computer connector 802 (such as a USB connector for example), and a level shifter 901. The computer 804 includes a display monitor 811, a pointing device 810, and a standard input device 812. The standard input device 812 can be a keyboard, a keypad, or another kind of device for entering information into the computer 804. The connector 801 has sockets 902, 904, 903 at locations 1, 2, 3 respectively that couple to pins 110, 112, 111 of the microphone output connector 103.

Figure 12:
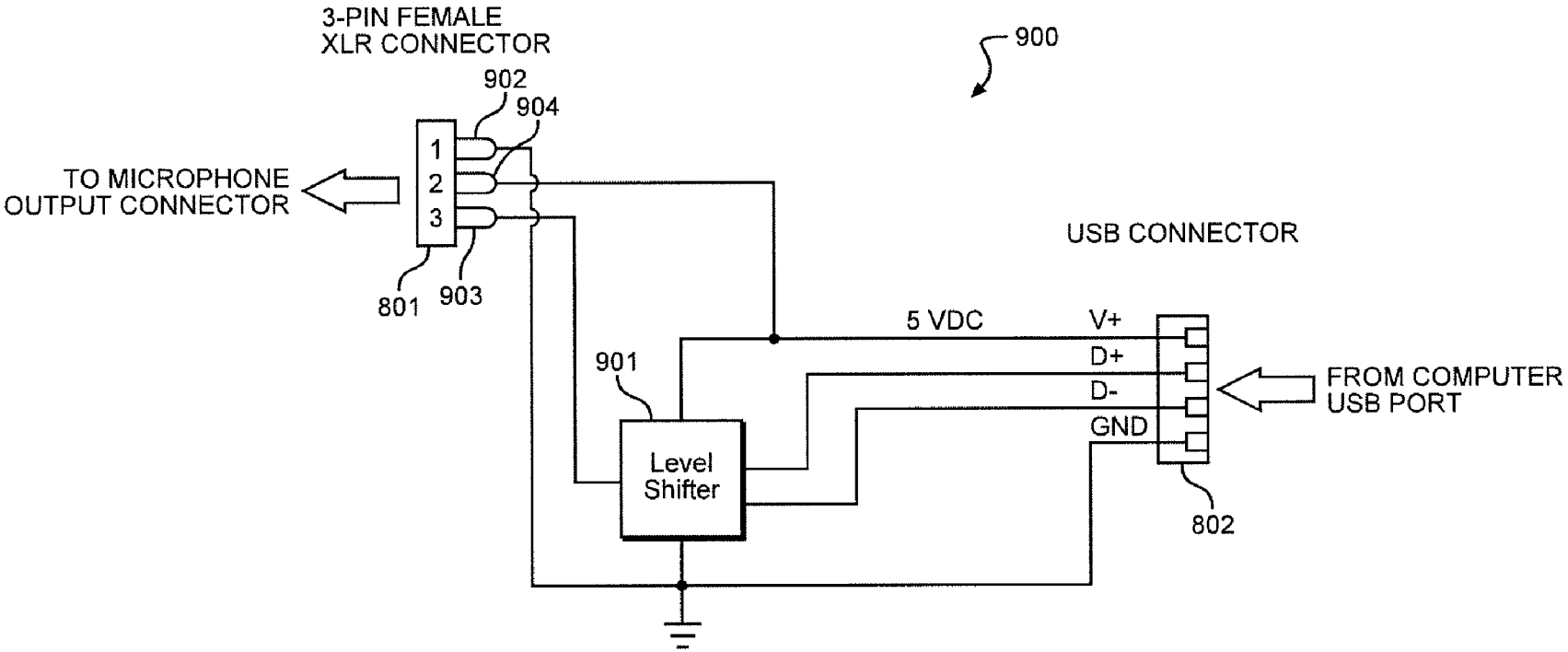
FIG. 12 is a schematic diagram of a programming adaptor.

FIG. 12 shows a schematic 900 of an embodiment of the programming adaptor 800. The adaptor 800 and the digital device 701 have level shifters 901, 723 which function cooperatively to translate a digital data signal from one level for the computer port 803 to another level for the microcontroller 702. The level shifters 901, 723 facilitate data communication between the computer 804 and the microcontroller 702 by translating the voltage levels of logical one and zero between the microcontroller 702 and the port 803.

FIG. 11 shows a socket 902 at location 1 of the female XLR connector 801 connecting to the pin 110 at location 1 of the male XLR output connector 103; a socket 903 at location 3 of the XLR connector 801 connecting to the pin 111 at location 3 of the XLR connector 103; and a socket 904 at location 2 of the XLR connector 801 connecting to the pin 112 at location 2 of the XLR connector 103. These connections of the female XLR connector 801 to the male XLR output connector 103 can be used to provide a computer DC voltage (5 volts DC) to the processor 102 and the microcontroller 702, and to couple a translated digital data signal between the level shifters 901, 723.

FIG. 10 shows that 5 volts DC is insufficient to turn on the Zener diode 731 of the initiator 724. But the 5 volts DC is sufficient to power the microcontroller 702 so the resistor 732 pulls the PROG terminal of the microcontroller 702 low and puts the microcontroller 702 into the PROGRAMMING mode. In the PROGRAMMING mode the microcontroller 702 communicates with the computer 804 through the programming adaptor 800 and the level shifters 901, 723.

In the PROGRAMMING mode, a person can use the standard input device 812 and the pointing device 810 to enter a user password and information about the operating parameters into an application program running on the computer 804. The application program can command the computer 804 to send a digital representation of the operating parameter information and the user password to the microcontroller 702. The microcontroller 702 can compare the user password to a predetermined password stored in a microcontroller 702 memory. When the user passwords match, the microcontroller 702 can receive and store the digitized operating parameter information in a nonvolatile digital memory 725 as a series of 1s and 0s. This can be a method of programming the microphone 101 and preparing it for the RUN mode.

The RUN mode can be entered by removing the programming adaptor 800 from the microphone 101, and connecting the microphone 101 to the mixing console 1311 via the microphone cable 1308 as shown in FIG. 2. The phantom power DC voltage turns on the Zener diode 731 and pulls the PROG terminal of the microcontroller 702 high. The microcontroller 702 enters the RUN mode and retrieves the operating parameter information stored in the memory 725. The microcontroller 702 interprets the retrieved information and turns on or off each of the analog switches 703-712 to set the operating parameters and make the microphone 101 ready for use.

Two-way communication between the microcontroller 702 and the computer 804 is possible in the PROGRAMMING mode. The computer 804 requests the microcontroller 702 to query the memory 725 and reply with the saved operating parameter information. The computer 804 interprets the reply and displays a representation of the operating parameters on the display monitor 811. Such a display may be similar to the user interface 3000 of FIG. 9.

Figure 13:
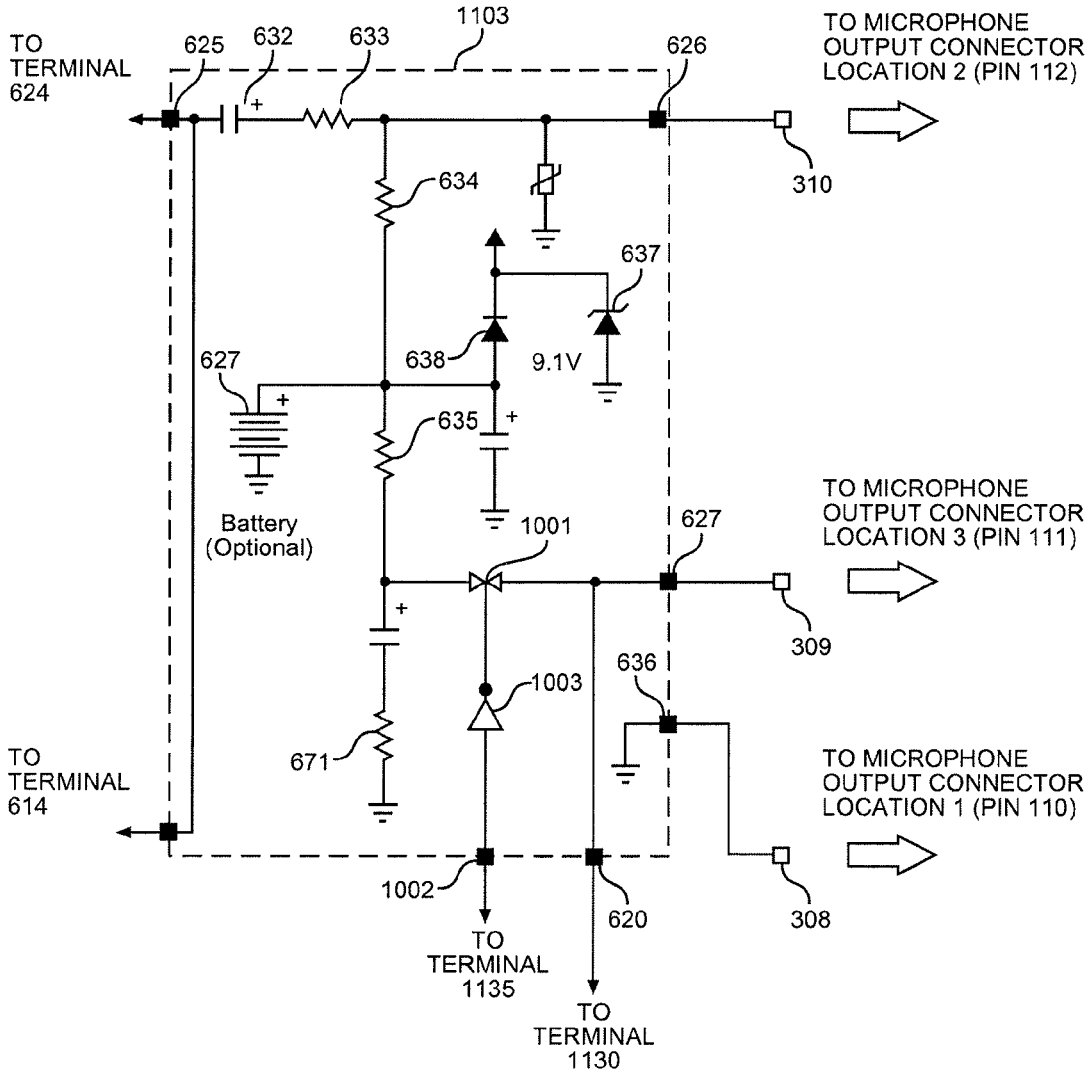
FIG. 13 is a schematic diagram of an alternative embodiment of a bidirectional output device for use with a programming adaptor not having a level shifter.
Figure 14:
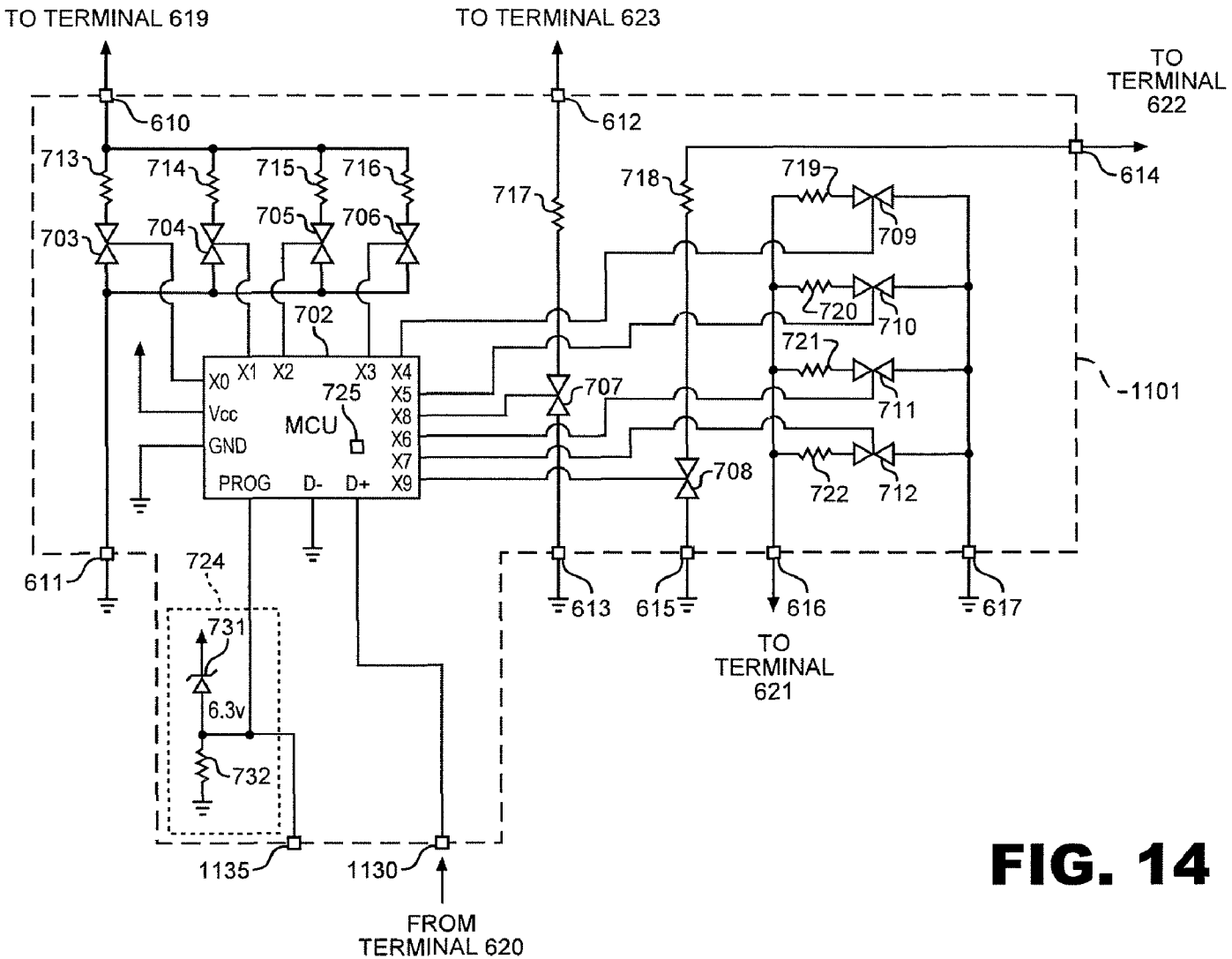
FIG. 14 is a schematic diagram of an alternative embodiment of a programming device for a programming adaptor without a level shifter.
Figure 15:
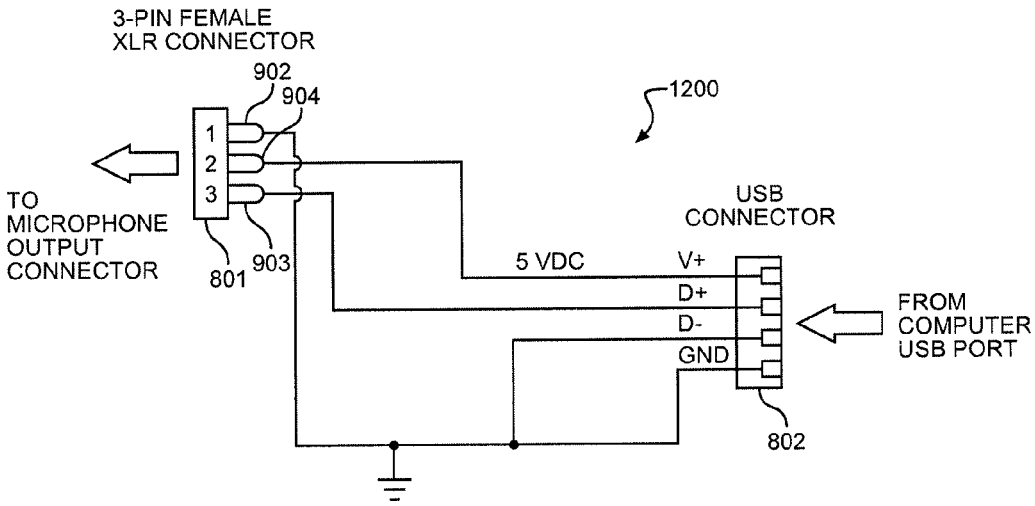
FIG. 15 is a schematic diagram of a programming adaptor not having a level shifter.

FIGS. 13, 14 and 15 show schematics for an alternative embodiment that does not include level shifters 901 or 723. In this embodiment, the impedance at the pin 111 is high enough to allow a direct connection between the microcontroller 702 and the computer port 803.

FIG. 13 shows a schematic of an embodiment of a bidirectional output device 1103 that can be used in place of the output device 603 of FIG. 4. FIG. 14 shows a schematic of an embodiment of a digital device 1101 that can be used in place of the programming device 604 of FIG. 4. FIG. 15 shows a schematic of 1200 of an adaptor that can be used in place of the adaptor 800 of FIG. 11. The initiator 724 of FIG. 14 is connected to an inverter 1003 of FIG. 13 via initiator control signal terminals 1135 and 1002. In the PROGRAMMING mode the initiator 724 provides an initiator control signal that pulls the input of the inverter 1003 low and turns off an analog switch 1001 to disconnect the low-value resistors 635, 671 from the terminal 309. Since the terminal 309 is coupled to the return pin 111 of the output connector 103, the turned-off analog switch 1001 makes the impedance at the pin 111 high enough to allow a direct connection between the microcontroller 702 and the computer port 803 without a level shifter. This enables the computer 804 and the microcontroller 702 to communicate over a direct connection which includes digital data terminals 1130 and 620, the terminal 627, the post 309, the pin 111, the socket 903, the computer connector 802 and the computer port 803

Figure 16:
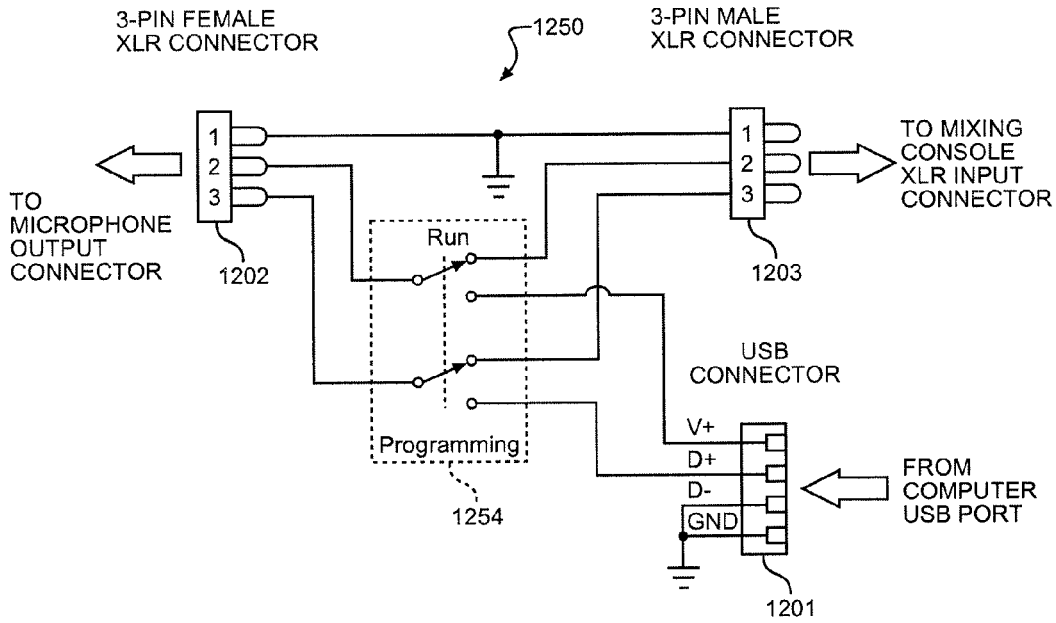
FIG. 16 is a schematic diagram of another embodiment of a programming adaptor having a switch.
Figure 17:
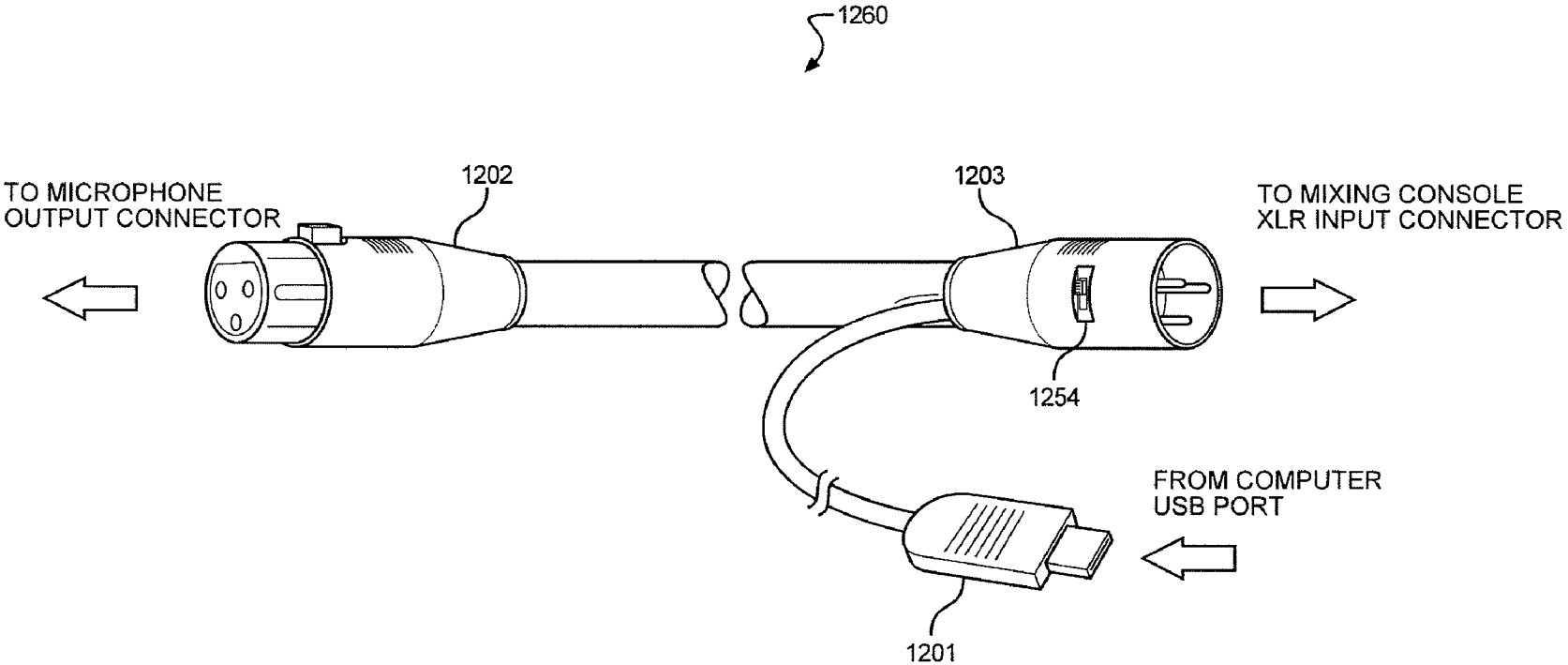
FIG. 17 is a drawing of a programming adaptor having a switch.

FIG. 16 shows a schematic 1250 of an embodiment of a switchable programming adaptor 1260 shown in FIG. 17. The adaptor 1260 includes a 3-pin female XLR connector 1202, a mixer connector 1203 (which can be a 3-pin male XLR connector), and a computer connector 1201 (which can be a USB connector). The XLR connector 1202 can be plugged into the output connector 103 of the microphone 101, the mixer connector 1203 can be plugged into the connector 1314 of the mixer 1311, and the computer connector 1201 can be plugged into the computer port 803. In this embodiment, a double-pole, double-throw (DPDT) switch 1254 is used to switch the microphone between the RUN mode and the PROGRAMMING mode. When the switch 1254 is switched to the up position (as shown in FIG. 16), the microphone is put into the RUN mode; and when the switch 1254 is switched to the down position, the microphone is put into the PROGRAMMING mode. The switch 1254 can be enclosed in any of the connectors 1201, 1202, 1203 or in an additional enclosure (not shown). It should be noted that the microphone 101 can include an auxiliary connector for programming. The programming adaptor can have a connector compatible with the auxiliary connector, and can connect to the microphone 101 via the auxiliary connector. The auxiliary connector can be coupled to the microcontroller 702 via the digital data terminal 1130 and other terminals to enable communication between the microcontroller 702 and the computer 804.

Figure 18:
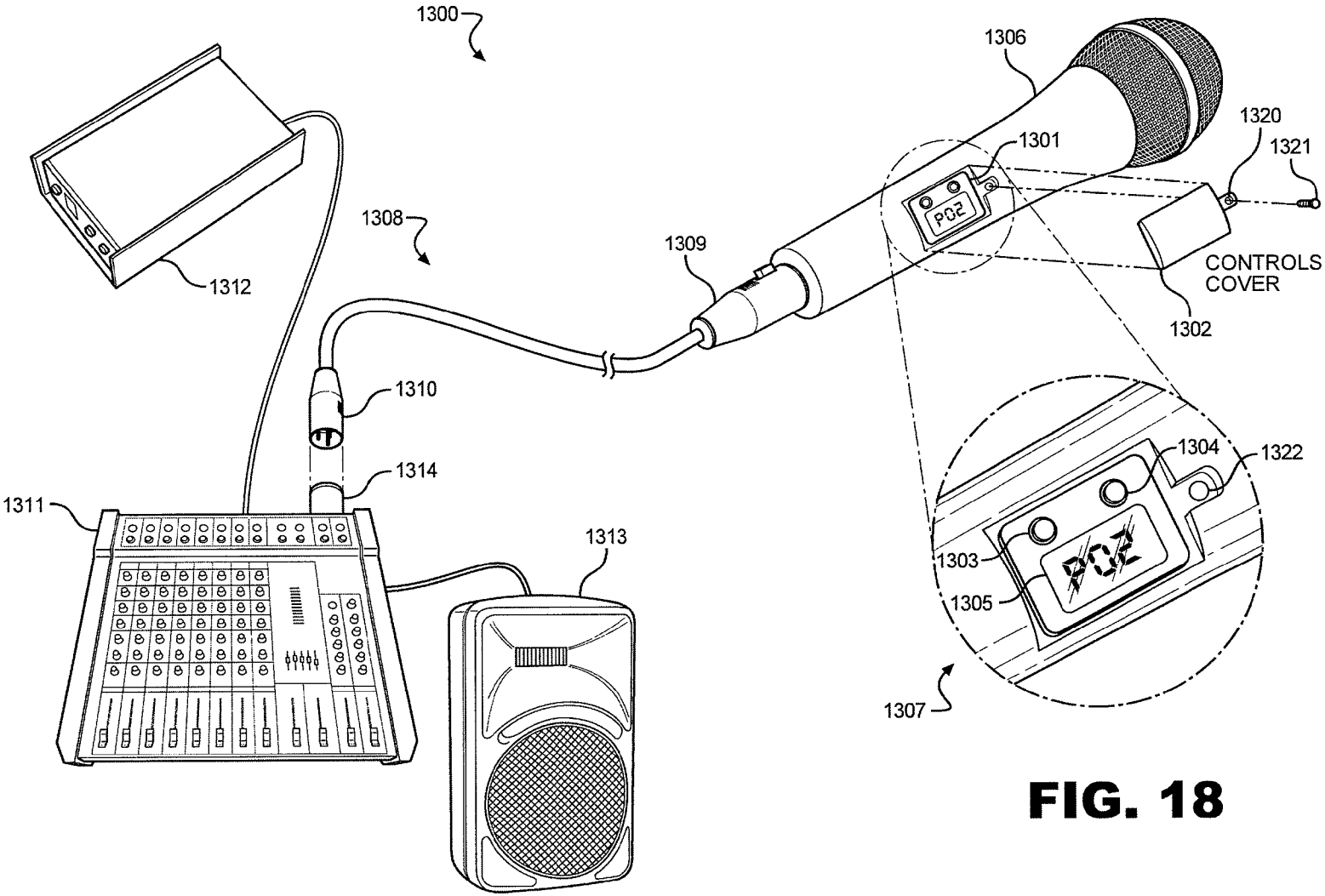
FIG. 18 is a drawing of an alternative embodiment of a programming device having a programming control.

FIG. 18 shows another personal microphone 1300 embodiment that includes a programming control 1307 which is another alternative embodiment of a programming device. The personal microphone 1300 includes the signal processor 102, a body 1306 with a recessed control cavity 1301, and a control cover 1302. The cover 1302 can be removed to expose increment/decrement push-button switches 1304, 1303; and a digital display 1305.

Figure 19:
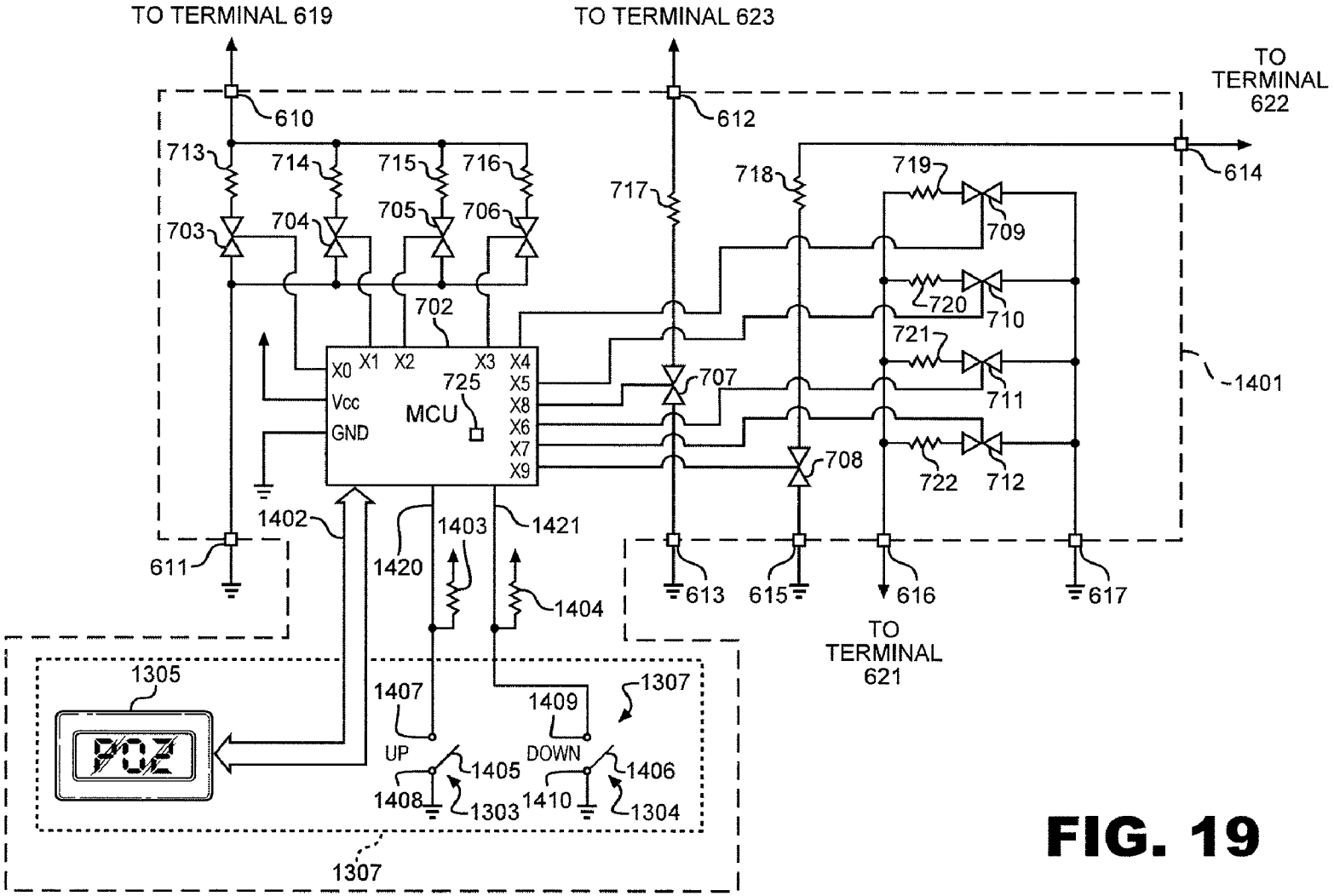
FIG. 19 is a schematic diagram of a programming control.

FIG. 19 shows an embodiment of a digital device 1401 with the programming control 1307 that can be used in place of the programming device 604 of FIG. 4. The display 1305 is coupled to the microcontroller 702 via a digital data buss 1402. The increment/decrement switches 1303, 1304 and pull-up resistors 1403, 1404 provide digital control signals 1420, 1421 to the microcontroller 702.

A predetermined number of programs can be preprogrammed into the memory 725 of the microcontroller 702. The memory 725 can store the following information for each program; a program name, operating parameter information, and a flag indicating the active program. The active program is the program which determines the operating parameters of the signal processor 102. The active program has a set flag. The flags of the other programs are reset.

In operation the microphone 1300 is connected to the mixing console 1311 via the microphone cable 1308. The phantom DC voltage puts the microcontroller 702 in the RUN mode to scan the memory 725 for a set flag and recall the flagged active program. The microcontroller 702 displays the active program's program name on the digital display 1305 and opens or closes each of the analog switches 703-712 according to the preprogrammed operating parameter information for the active program.

The active program is changed by actuating one of the switches 1303, 1304. The switch 1303 is actuated by applying a pressing force to actuator 1405 which creates a short circuit between terminals 1407 and 1408. The switch 1304 is actuated by applying a pressing force to actuator 1406 which creates a short circuit between terminals 1409 and 1410. The switches 1303, 1304 can be momentary-contact switches that make a short circuit only while a pressing force is applied to the respective actuators 1405, 1406.

When the switch 1303 is pressed and released the microcontroller 702 performs the following steps to change the active program:

1. Temporarily leaves the RUN mode and enters the PROGRAMMING mode;
2. Resets the active program's flag in the memory 725;
3. Sets the next program's flag in the memory 725 to make it the new active program;
4. Returns to the RUN mode;
5. Recalls the preprogrammed information for the new active program from the memory 725;
6. Displays the program name of the new active program on the display 1305; and
7. Opens or closes each of the analog switches 703-712 according to the preprogrammed operating parameters of the new active program.

An embodiment of the switch 1303 can cause the microcontroller 702 to repeat the above steps once every one half second when the switch 1303 is pressed and held for more than 2 seconds. The switch 1304 operates similarly to decrement the program name and set the new active program. The microphone can produce the processed output signal without interruptions regardless of any switches are pressed.

When the microphone 1300 is disconnected from the mixing console and reconnected later, the microcontroller 702 performs the following steps to restore the active program:

1. Enters the RUN mode;
2. Scans the memory 725 for a set flag to determine the active program;
3. Recalls the preprogrammed information for the flagged active program;
4. Displays the program name of the active program on the display 1305; and
5. Opens or closes each of the analog switches 703-712 according to the preprogrammed operating parameters of the active program.

The cover 1302 can include a security device that comprises an access screw 1321 and a clearance screw hole 1320. To close the security device, the cover 1302 can be put over the programming control 1307 and the screw 1321 can be inserted through the screw hole 1320 and into a threaded screw hole 1322. The cover 1302 can include a hinge for swinging the cover 1302 open, a slide for sliding the cover 1302 open, and/or another kind of device for opening and closing the cover 1302.

Figure 20:
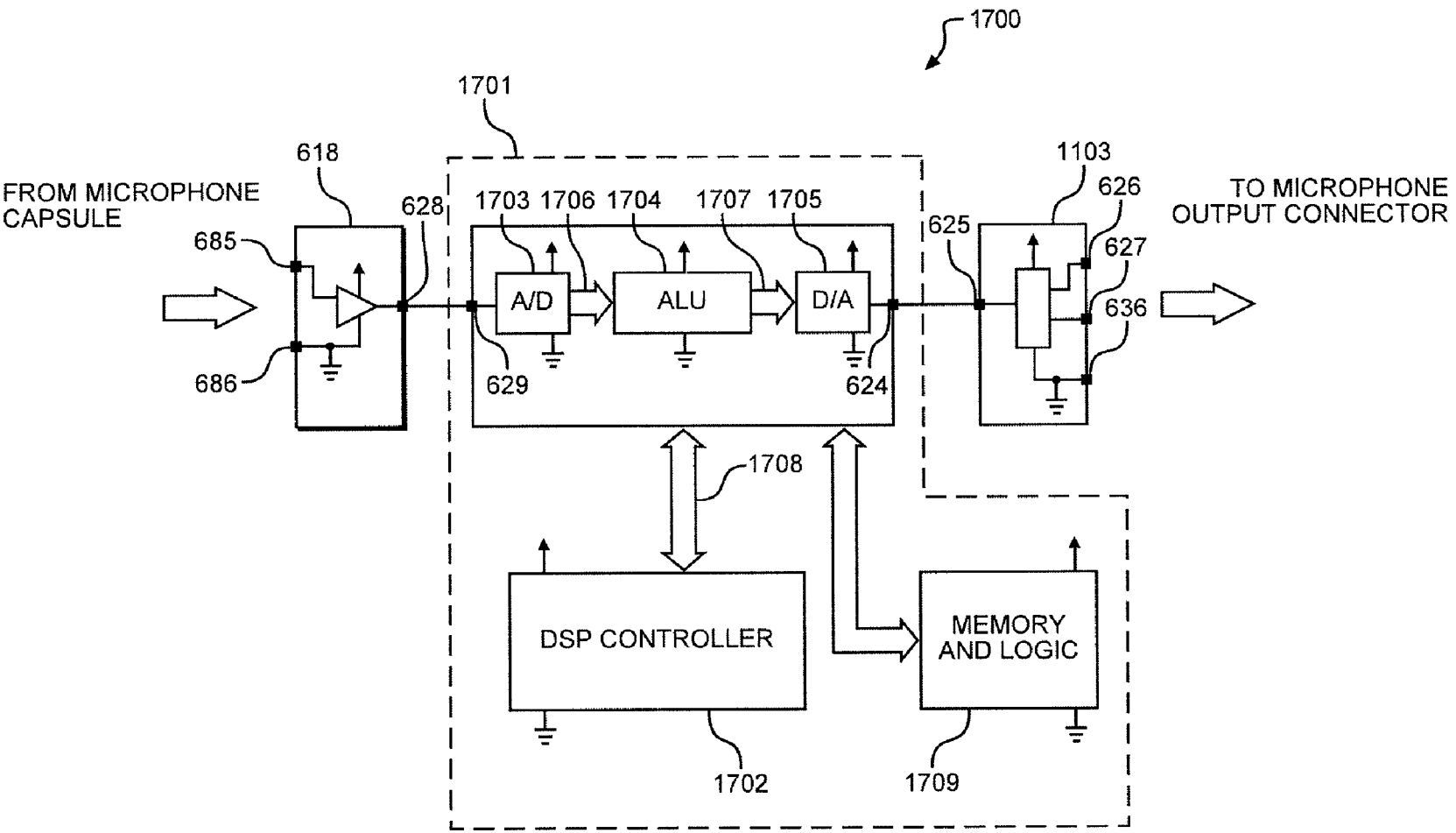
FIG. 20 is a block diagram of an alternate embodiment of a programmable signal processor having a digital signal processor (DSP)

FIG. 20 shows a schematic 1700 of an alternative embodiment of the processor 102 that includes a digital signal processor (DSP) 1701 for digitally processing the processed output signal. In operation the input signal is coupled to the signal input terminals 685, 686. The preamplifier 618 applies the analog signal to an analog-to-digital (A/D) converter 1703 via the terminals 628, 629. The A/D converter 1703 converts the input signal to an input digital signal 1706. The preamplifier 618 can be a component of the A/D converter 1703, or a component of the capsule 150, or the preamplifier 618 can be a separate device as shown. The input signal can be coupled directly to the A/D converter 1703 so that the analog signal and the input signal can be the same signal. An arithmetic logic unit (ALU) 1704 performs arithmetic and logic operations on the input digital signal 1706 to produce an output digital signal 1707. A digital-to-analog (D/A) converter 1705 converts the output digital signal 1707 into the processor output signal which is coupled to the bidirectional output device 1103 via the terminals 624, 625. The ALU 1704 executes preprogrammed instructions to process the processed output signal. The DSP 1701 can emulate a dynamic range compressor and optionally other signal processor devices.

The microcontroller 702 can have a predetermined password and a security device for avoiding unwanted changes to the operating parameters. The security device can include the digital memory 725 storing a predetermined password and the user entering a user password via the push-button switches 1304, 1303. The user password can be a sequence of presses on the switches 1304, 1303. For example, the user password could be entered by the following steps; press and hold both switches 1304, 1303 simultaneously for three seconds; release both switches 1304, 1303; press and release the switch 1304 five times, press and release the switch 1303 twice; then press and release the switch 1304 once. The microcontroller 702 can be programmed to monitor the switches 1304, 1303 for the entry of the user password. When the user password matches the predetermined password, the microcontroller 702 can enable operating parameters to be changed for a limited time period. The limited time period can be, for example, 30 seconds. The sequence of presses can be referred to as a combination which the user can enter to unlock the security device.

The DSP 1701 includes a DSP controller 1702 that sets the operating parameters of the processor 102 by sending instructions 1708. The DSP 1701 also includes a memory and logic unit 1709 for storing the preprogrammed instructions, for storing intermediate results produced by the ALU 1704, and for supporting necessary executive functions of the DSP 1701.

The DSP controller 1702 can include the programming control 1307 as shown in FIG. 19 to change the active program of the DSP 1701. The DSP controller 1702 can also include the initiator 724, the terminal 1130, and a D+ data terminal as shown in FIG. 14 to facilitate a connection between the DSP 1701 and the computer 804 so that the computer 804 can load preprogrammed instructions into the memory unit 1709 of the DSP 1701.

The DSP 1701 can be powered by the phantom power supply 1312. Commercially available phantom power supplies typically have a maximum current delivery capability of 15 milliamperes or less. The phantom current is usually limited by a pair of 6.8K ohm resistors located in the mixing console 1311 that carry current from a 48 volt source in the phantom power supply 1312 to the DSP 1701 via a preamp of the mixing console 1311, the input connector 1314, the microphone cable 1308, and the output connector 103, and other connections. The maximum current delivery capability of a typical phantom power supply can be measured with a DC ammeter by shorting the sockets at locations 2, 3 of the 3-pin female XLR connector 1309 (shown in FIG. 2) and measuring the DC current flow from the sockets 2, 3 to the socket at location 1 of the connector 1309 with the ammeter. This measurement is typically less than 15 milliamperes DC. The DSP 1701 is a low-power device that operates with 15 milliamperes of current or less.

Figure 21:
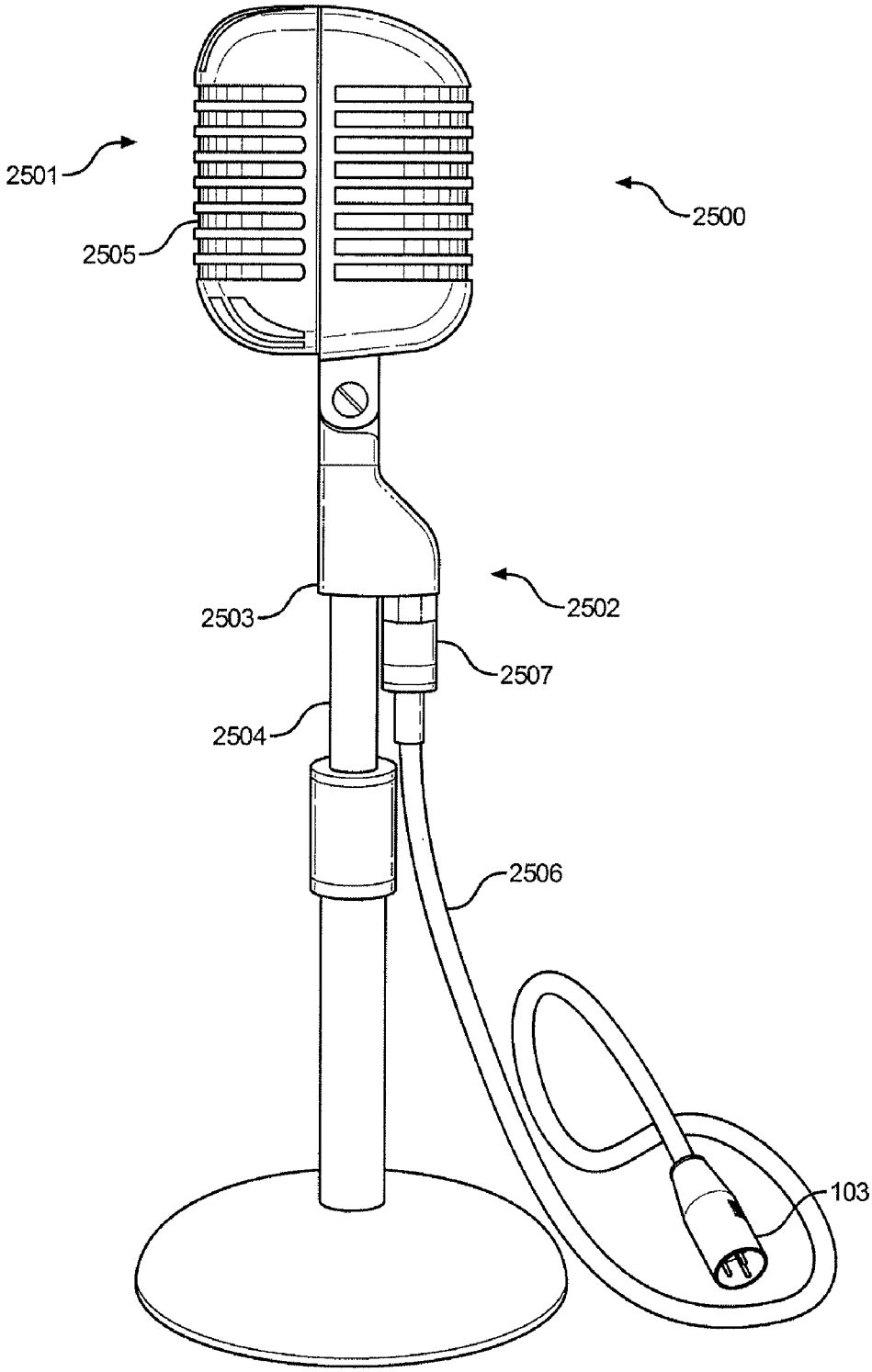
FIG. 21 is a drawing of an alternative embodiment of a personal microphone that can be referred to as a radio announcer microphone.

FIG. 21 shows another embodiment of a stage-microphone form factor having a structure 2500. This is referred to as a radio announcer microphone, a classic microphone, or an Elvis microphone. It has a two-piece body comprising a windscreen 2505 and a microphone-stand connector 2503. The two-piece body has an input end 2501 (the proximal end) and an output end 2502 (the distal end). The microphone-stand connector 2503 couples to a microphone stand 2504. The processor 102 and a capsule (not shown) can be located at the input end 2501 behind the windscreen 2505. An output connector is located at the output end 2502 and connects to a multi-pin Amphenol connector 2507 located at one end of a microphone cable 2506. The output connector 103 is located at the other end of the cable 2506. The Amphenol connector 2507 may not be mechanically compatible with XLR connectors.

Figure 22:
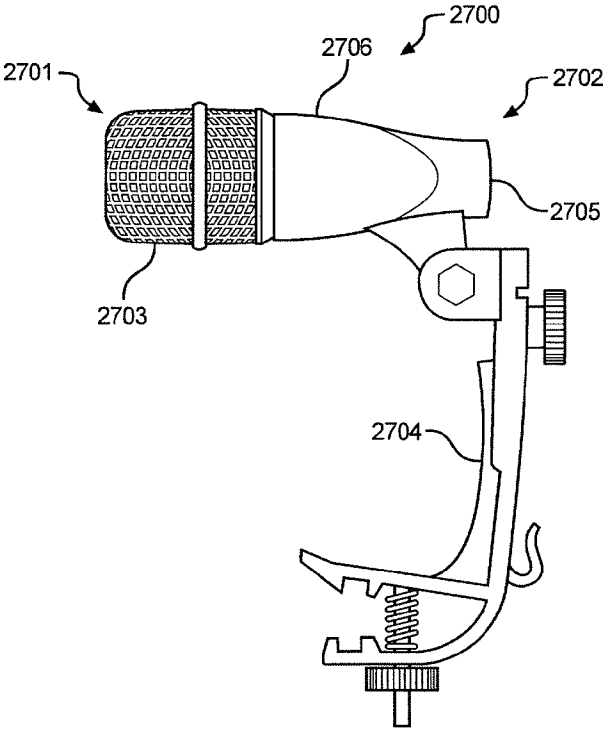
FIG. 22 is a drawing of an alternative embodiment of a personal microphone for musical instruments.

FIG. 22 shows another embodiment of a stage-microphone form factor having a structure 2700. This is referred to as a drum microphone or a musical instrument microphone. It has a body 2706 with an input end 2701 (the proximal end), an output end 2702 (the distal end), and a clamp 2704 for attaching the microphone to a drum or a musical instrument. A capsule (not shown) is located at the input end 2701 behind a windscreen 2703. A microphone output connector 2705 is located at the output end 2702. The microphone output connector 2705 can be coupled to a 3-pin female XLR connector. The processor 102 is located inside the body 2706.

Figure 23:
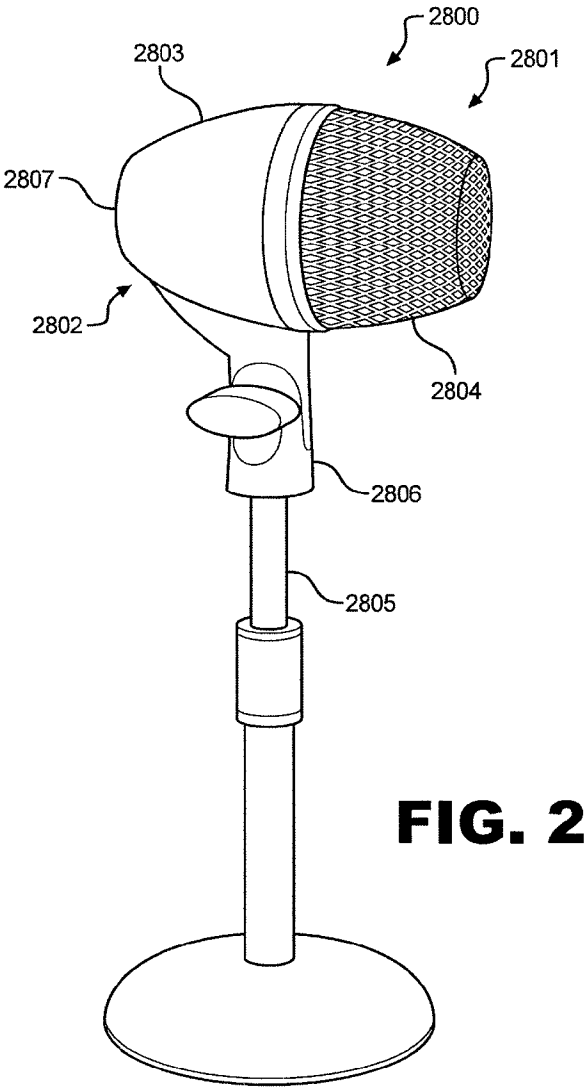
FIG. 23 is a drawing of an alternative embodiment of a personal microphone for a kick drum.

FIG. 23 shows another embodiment of a stage-microphone form factor having a structure 2800. This is referred to as a kick drum microphone. It has a body 2803 and a microphone-stand connector 2806. The body 2803 has an input end 2801 (the proximal end) and output end 2802 (the distal end). The microphone-stand connector 2806 couples to a microphone stand 2805. A capsule (not shown) is located at the input end 2801 behind a windscreen 2804. The processor 102 is located inside the body 2803. A microphone output connector 2807 is located at the output end 2802. The microphone output connector 2807 can be coupled to a 3-pin female XLR connector.

In another embodiment of a stage-microphone form factor, the capsule 150 as shown in FIG. 2 is rotated ninety degrees. This is referred to as a side-address microphone.

FIG. 4 shows the processor 102 having a battery 689 to provide the DC power supply voltage to the processor 102 to operate the microphone 101 when a phantom power supply is not available. The battery 689 is included when the digital memory 725 is a volatile memory type that requires a backup battery. The battery 689 is not required when the digital memory 725 is nonvolatile. The battery 689 can be rechargeable. It can be recharged by the phantom power supply. With the battery 689 recharged, the microphone 101 can be used without the phantom power supply.

Figure 24:
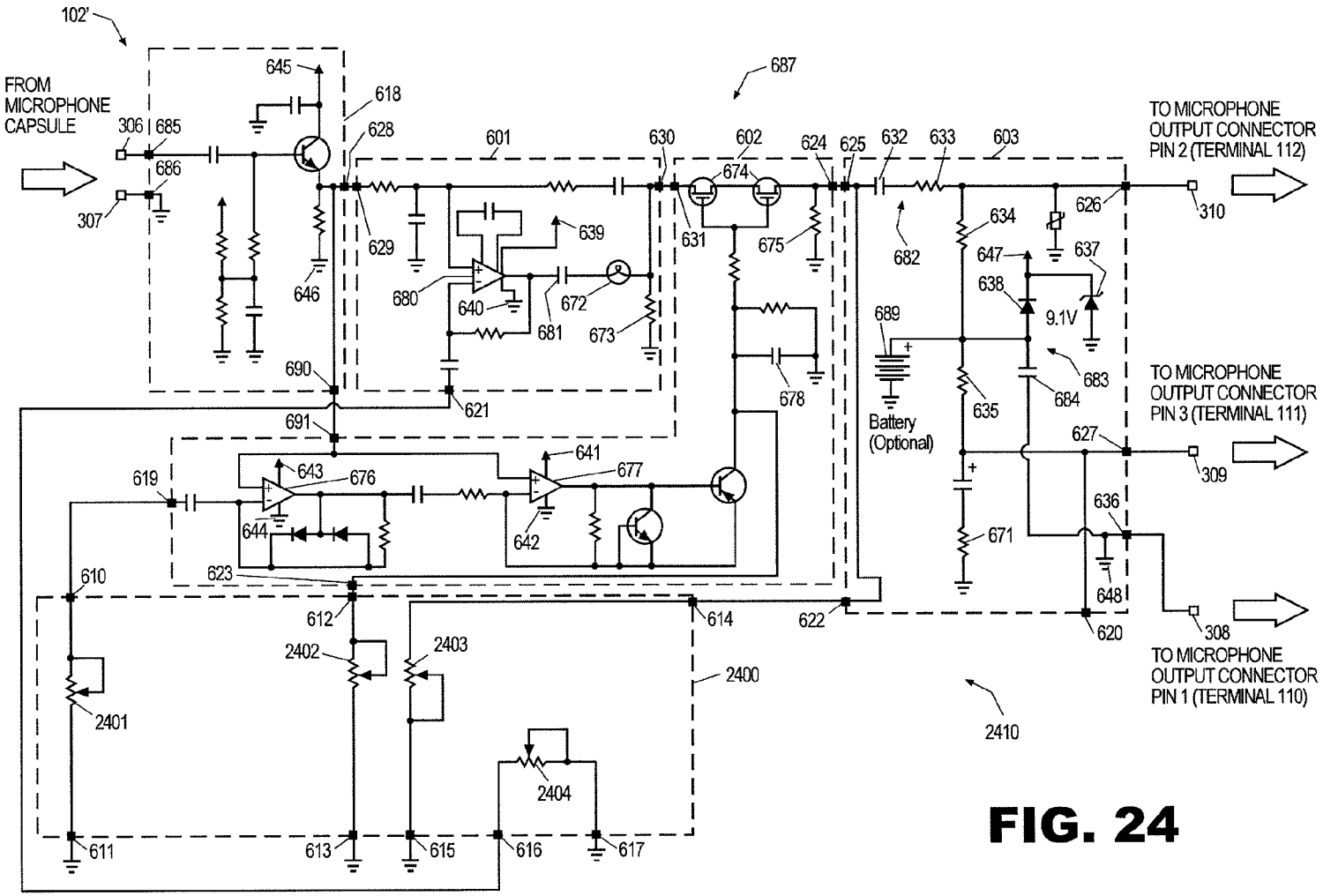
FIG. 24 is a schematic diagram of an adjustable signal processor having potentiometers for setting operating parameters.

FIG. 24 shows an embodiment of an adjustable signal processor 102' that can replace the programmable signal processor 102. A schematic 2410 shows the processor 102' having an adjustment device 2400. The adjustment device 2400 includes potentiometers 2401-2404 as adjustment devices for setting the operating parameters of the processor 102'. Each potentiometer has a theoretically infinitely variable resistor element and a wiper that enables any resistance between predetermined minimum and maximum values to be obtained by adjusting an actuator such as a rotatable shaft or a slidable member. The actuator is adjusted to change the potentiometer resistance. Each adjustment of the actuator yields a new set of operating parameter which in theory can not be repeated because there are an infinite number of possibilities. The potentiometers 2401-2404 can be secured inside the body 115 of the microphone 101. To open the security device, the output connector 103 can be removed and the processor 102' can be pulled out of the body 115 through the access hole 114 to expose the potentiometers 2401-2404 for adjustments.

The noise-gate threshold potentiometer 2401 is coupled between programming terminal 610 and ground terminal 611. The noise-gate release time potentiometer 2402 is coupled between programming terminals 612 and ground terminal 613. The volume control potentiometer 2403 is coupled between programming terminals 614 and ground terminal 615. The compression threshold potentiometer 2404 is coupled between programming terminals 616 and ground terminal 617.

In another embodiment, the security device can include one or more access holes in the body 115. There can be one access hole for each potentiometer. To open this security device, a tool (such as a screwdriver) can be inserted into a hole to engage and rotate a potentiometer actuator. In another embodiment, the potentiometer actuators can extend through one or more holes in the body 115 to be accessible from the outside. To avoid unwanted changes to the operating parameters the security device can include the controls cover 1302 and access screw 1321 (FIG. 18) to cover the actuators.

Figure 25:
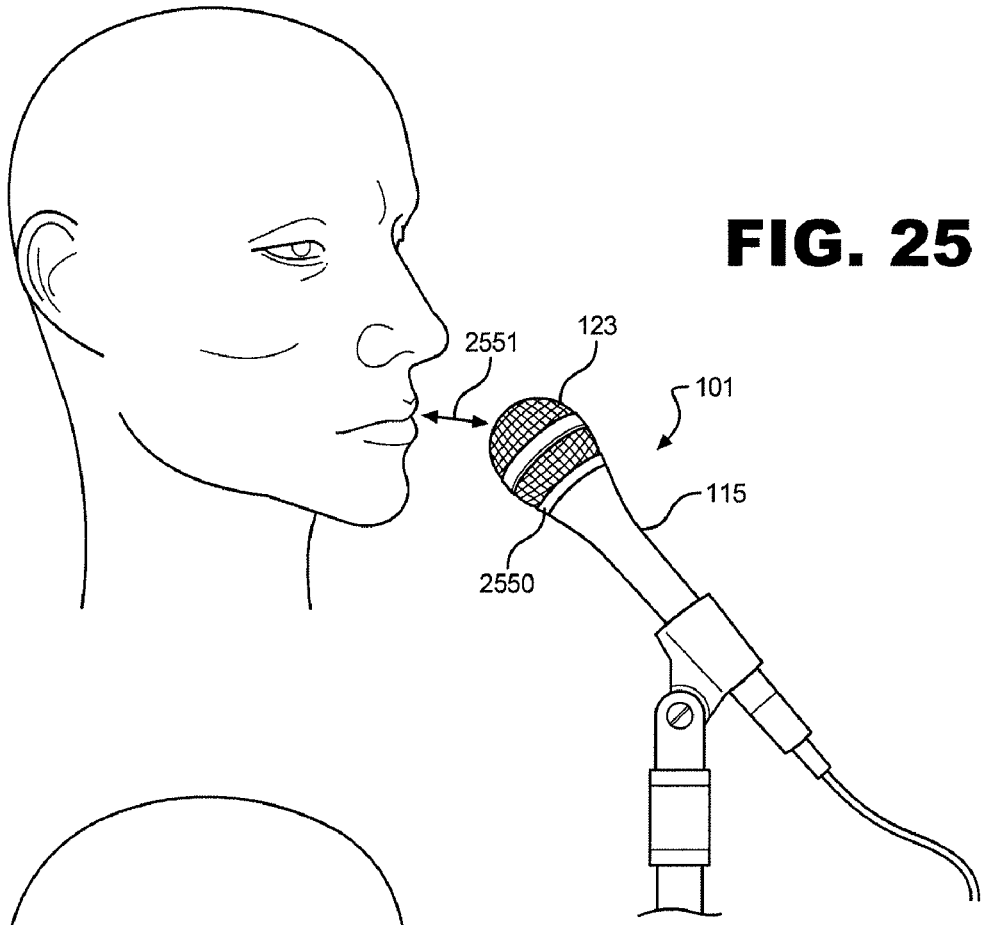
FIG. 25 is a drawing of a personal microphone with a removable ring for changing bass boost caused by proximity effect.

FIG. 25 shows an embodiment of a personal microphone 101 that includes a removable ring 2550. In this embodiment, the capsule 150 has a cardoid pickup pattern and a proximity effect. When the microphone 101 is used in close proximity to the performer's mouth, the input signal increases but the proximity effect increases bass frequencies more than treble frequencies. Close proximity refers to the windscreen 123 being located a distance 2551 from the mouth (or another sound source) less than about 35 millimeters.

The proximity effect creates the perception of a bass boost in the processed output signal. The ring 2550 is an adjustable locating device for the capsule 150 for changing bass boost caused by the proximity effect. In operation the ring 2550 can be removed or installed depending on the performer's preference.

Figure 26:
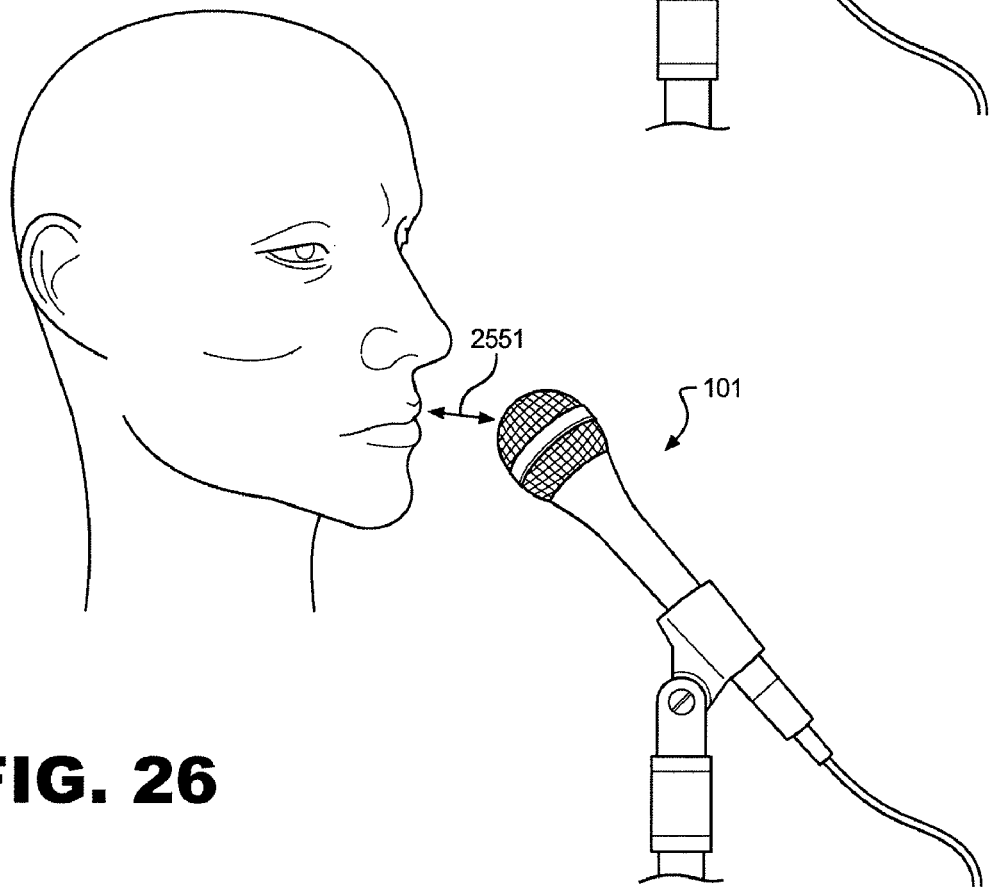
FIG. 26 is a drawing of a personal microphone with a removable ring removed to increase the bass boost.

FIG. 26 shows the ring 2550 removed to put the capsule 150 closer to the mouth for greater bass boost. FIG. 25 shows the ring 2550 installed for less bass boost.

Figure 27:
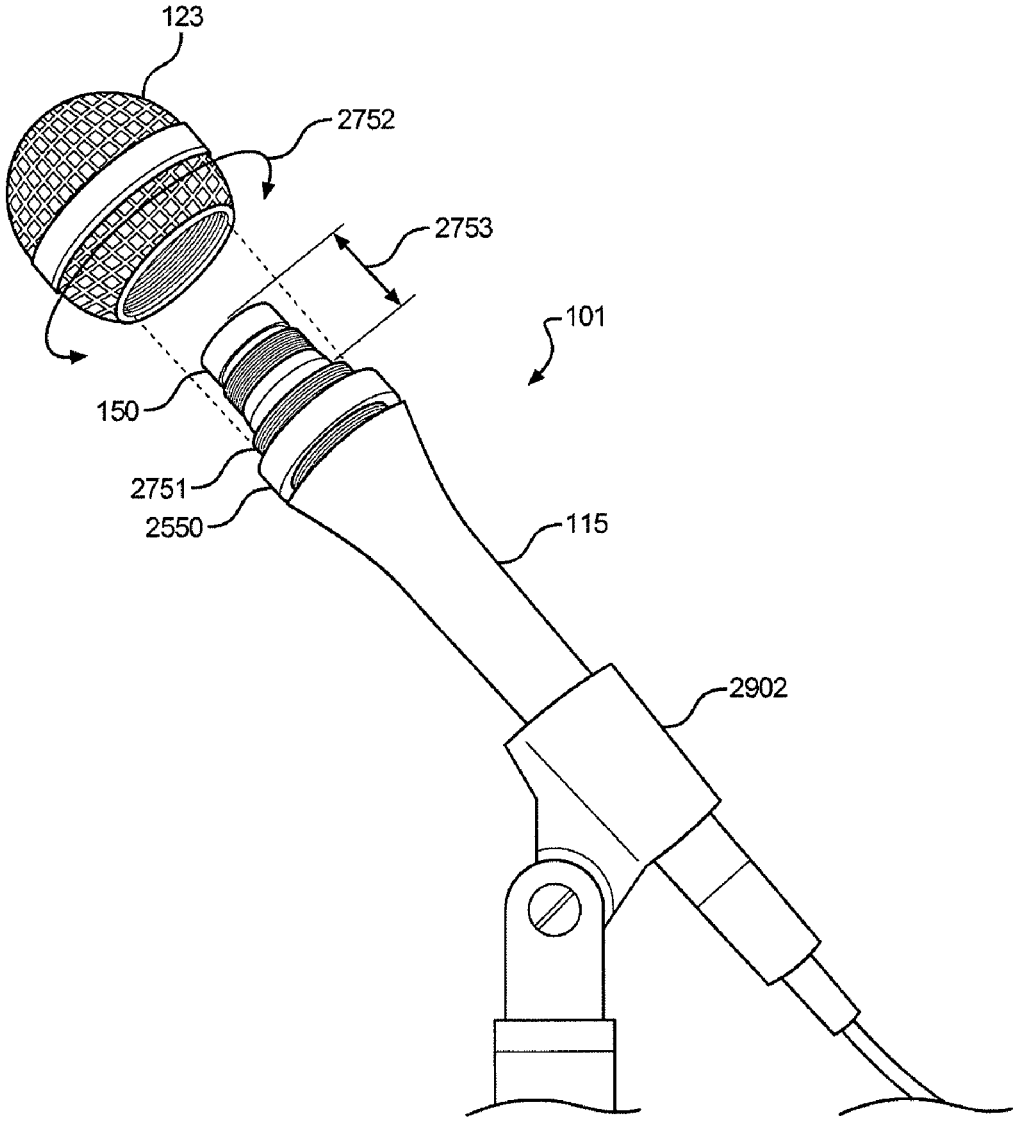
FIG. 27 is an exploded view of a removable ring located between a microphone body and a windscreen.

FIG. 27 shows an exploded view of the ring 2550 installed over a threaded cylinder member 2751 of the body 115. The ring 2550 can be removed by rotating the windscreen 123 to unscrew it from the cylinder 2751. The ring 2550 which may not have any screw threads can be pulled off the cylinder 2751 and the windscreen 123 can be reinstalled by rotating it in the opposite direction. When the ring 2550 is removed, the capsule 150 is located deeper inside the windscreen 123 and closer to the performer's mouth. The capsule 150 can be located closer to the front 2754 of the windscreen 123 because the capsule 150 protrudes a predetermined protrusion distance 2753 from the front of the body 115.

Figure 28:
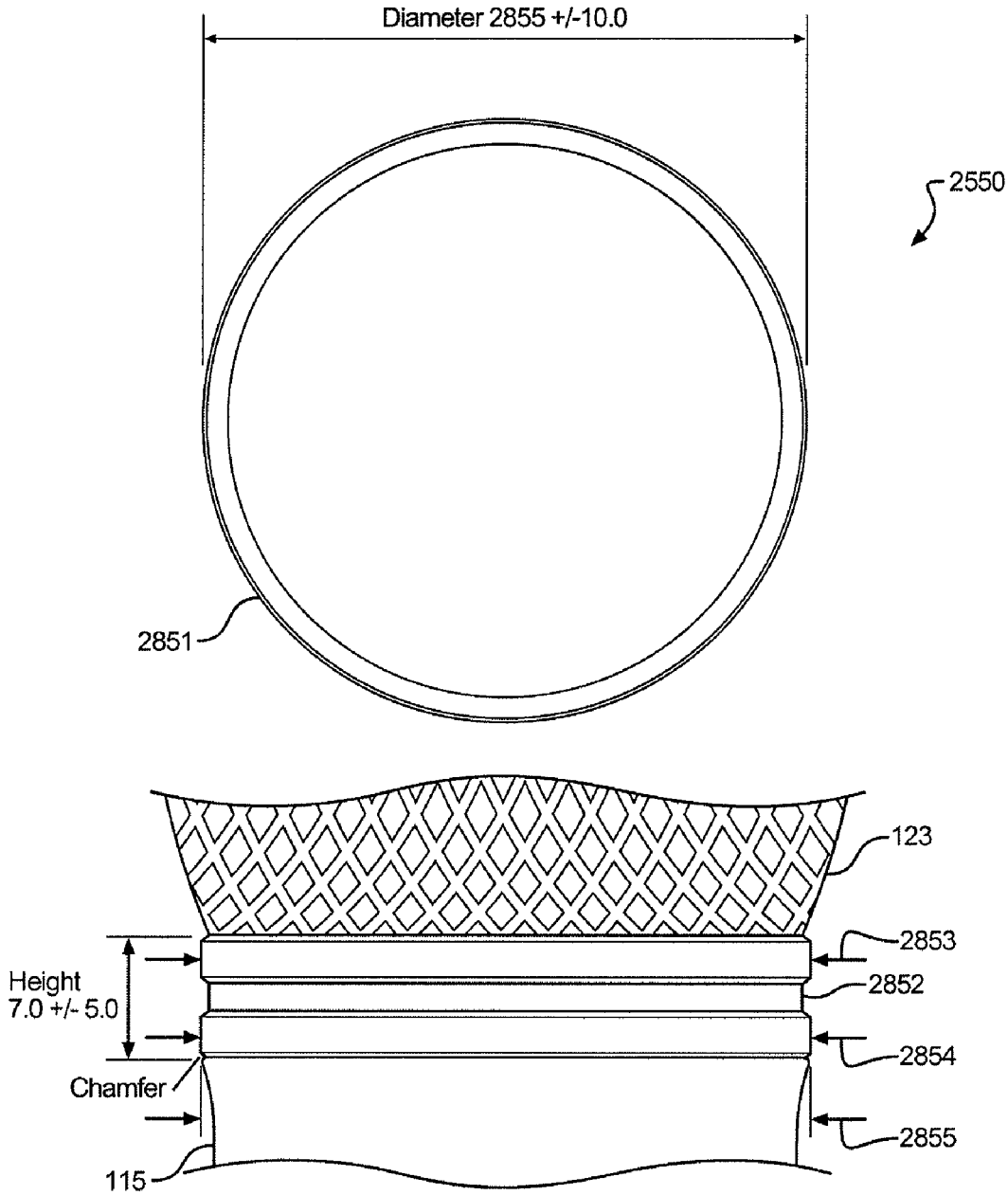
FIG. 28 is a drawing of a removable ring in top view and side view.

FIG. 28 shows a top view 2851 and a side view 2852 of the ring 2550 including exemplary dimensions in millimeters. For a predetermined top diameter 2855 of the body 115, a top diameter 2853 and a bottom diameter 2854 of the ring 2550 can be equal to the diameter 2855 with a tolerance of +/−10.0 millimeters or less. The windscreen 123 can be fashioned to adjoin the diameter 2855. The specifications given enable the ring 2550, body 115, and windscreen 123 to be fashioned so as to provide acceptable cosmetic appearance whether the ring 2550 is installed or not.

Figure 29:
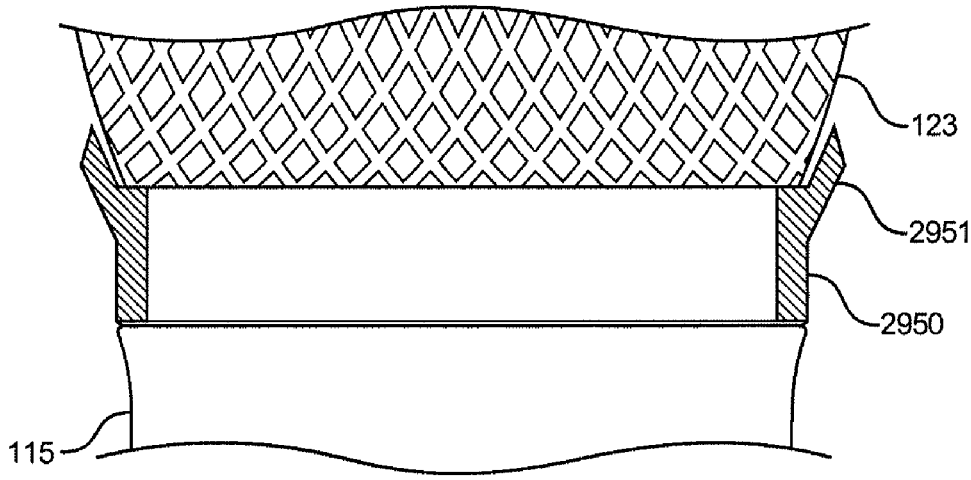
FIG. 29 is a cut-away view of an alternative removable ring having an overlap ring.
Figure 30:
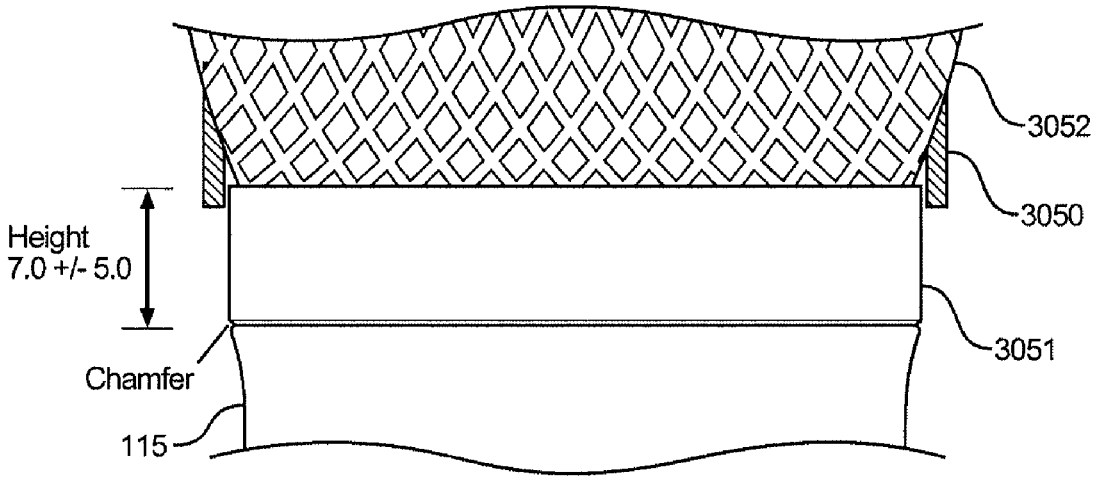
FIG. 30 is a drawing of an alternative removable ring with a windscreen having an overlap ring shown in cut-away view.

FIG. 29 shows another embodiment of a removable ring 2950 in cut-away view. The ring 2950 includes an overlap ring member 2951. FIG. 30 shows another embodiment of a removable ring 3051 and a windscreen 3052 which has an overlap ring member 3050 shown in cut-away view. Overlap ring members may be on a removable ring, a windscreen, and/or a microphone body. Exemplary dimensions are given in millimeters.

Any of the removable rings 2550, 2950, 3051 may have identification marks, model numbers, or logos and may have other decorations or features as well.

Figure 31:
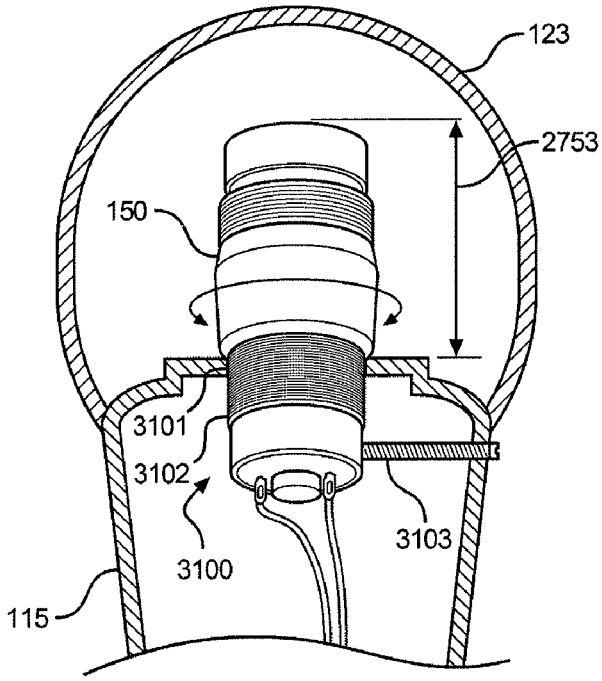
FIG. 31 is a drawing of an adjustable locating device for changing bass boost.

FIG. 31 shows another adjustable locating device having a capsule locating device 3100 and a lock device 3103. The capsule locating device 3100 includes screw threads 3101 on the body 115 and screw threads 3102 on the capsule 150. In operation the windscreen 123 can be removed, the capsule 150 can be rotated to adjust the protrusion distance 2753, and the lock 3103 can be rotated to push against the capsule 150 and lock it in place. The lock 3103 can be a set screw as shown, a moveable shaft, or a friction device. A friction device creates friction to restrict capsule rotation. For adjustments, the capsule can be rotated by applying extra force to overcome the friction device. In another embodiment of this adjustable locating device the screw threads 3101, 3102 are replace by smooth surfaces. Adjustments are made by sliding the capsule 150 relative to the body 115.

Figure 32:
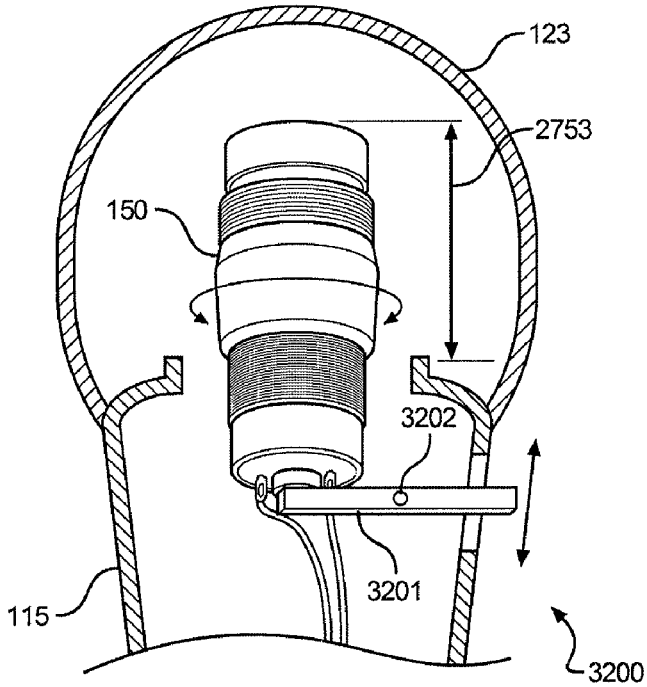
FIG. 32 is a drawing of a capsule locating device having a lever for changing bass boost.

FIG. 32 shows another capsule locating device 3200 having a lever 3201 and a fulcrum 3202. The lever 3201 is attached to the capsule 150. The fulcrum 3202 is attached to the body 115 by a post inserted in a hole in the lever 3201. There is a press-fit tolerance between the post diameter and the hole to create friction between the lever 3201 and the fulcrum 3202. In operation the lever 3201 can be moved up or down to move the capsule 150 and adjust the protrusion distance 2753.

While preferred embodiments of the invention have been disclosed, illustrated and described, it will be appreciated that other embodiments, adaptations and variations of the invention will be readily apparent to those skilled in the art.

I claim:

1. A personal microphone that receives a phantom direct current (DC) voltage and provides a processed output signal having a dynamic range, the personal microphone comprising;

a microphone output connector for receiving the phantom DC voltage and providing the processed output signal, the microphone output connector having pins suitably arranged for coupling to a 3-pin female XLR connector;

a structure having a form factor for live performance;

a capsule for receiving acoustic energy and generating an input signal; and a programmable signal processor for converting the input signal into the processed output signal, the programmable signal processor being located in the structure, the programmable signal processor including;

signal input terminals coupled to the capsule for receiving the input signal from the capsule;

input/output terminals coupled to the microphone output connector for receiving the phantom DC voltage from the microphone output connector, the input/output terminals providing the processed output signal to the microphone output connector;

a dynamic range compressor for compressing the dynamic range of the processed output signal;

a nonvolatile memory device for storing operating parameters of the programmable signal processor; and a programming device for setting the operating parameters of the programmable signal processor, the programming device being coupled to the nonvolatile memory device for retrieving information about the operating parameters of the programmable signal processor from the nonvolatile memory device to set the operating parameters for the programmable signal processor.

2. The personal microphone of claim 1, further comprising a security device for avoiding unwanted changes to the operating parameters of the programmable signal processor.

3. The personal microphone of claim 2, wherein the security device includes an access hole located in the structure, the programmable signal processor being removable from the structure through the access hole.

4. The personal microphone of claim 1, wherein the nonvolatile memory device comprises a digital memory, and the programming device comprises a microcontroller having a PROGRAMMING mode of operation, the microcontroller storing the information about the operating parameters of the programmable signal processor in the digital memory when the microcontroller is in the PROGRAMMING mode of operation.

5. The personal microphone of claim 4, further comprising a security device for avoiding unwanted changes to the operating parameters of the programmable signal processor, wherein the security device comprises a programming adaptor coupled to the microphone, the programming adaptor comprising:

a computer connector for coupling the programmable signal processor to a computer port; and a programming connector for coupling to at least one of the microphone output connector and an auxiliary connector.

6. The personal microphone of claim 5, wherein:

the microcontroller has a predetermined password; and the microphone further comprises a secondary security device for avoiding unwanted changes to the operating parameters of the programmable signal processor, the secondary security device confirming a user password entered by a user and only allowing changes to the operating parameters of the programmable signal processor when the user password matches the predetermined password.

7. The personal microphone of claim 4, wherein the programming device further comprises a programming control having a switch, and the microcontroller changes the operating parameters of the programmable signal processor in response to the switch being actuated.

8. The personal microphone of claim 7, further comprising a security device for avoiding unwanted changes to the operating parameters of the programmable signal processor.

9. The personal microphone of claim 8, wherein the security device comprises;

an access screw;

a threaded hole in the structure ; and a control cover covering the programming control, the control cover including a screw hole;

wherein the access screw is inserted through the screw hole of the control cover and into the threaded hole in the structure to attach the control cover to the structure.

10. The personal microphone of claim 8, wherein the microcontroller stores a predetermined password, and the security device accepts a user password entered by a user, compares the user password to the predetermined password, and only allows changes to the operating parameters of the programmable signal processor when the user password matches the predetermined password.

11. The personal microphone of claim 1, wherein the non-volatile memory device includes a header with a pair of posts and a shunt, the shunt being pushed onto the pair of posts to create a short circuit between the pair of posts.

12. The personal microphone of claim 11, further comprising a computer having a display monitor, the display monitor displaying a representation of the header and the shunt to provide guidance for arranging the shunt on the header.

13. The personal microphone of claim 1, wherein the programmable signal processor comprises a digital signal processor having an analog-to-digital converter, an arithmetic logic unit, and a digital-to-analog converter, wherein the analog-to-digital converter converts an analog signal derived from the input signal into a digital input signal, the arithmetic logic unit receives the digital input signal and provides a digital output signal, and the digital-to-analog converter converts the digital output signal into a processor output signal, the processed output signal being derived from the processor output signal.

14. The personal microphone of claim 13, wherein the analog signal is the same as the input signal.

15. The personal microphone of claim 1, wherein the structure has a stage-microphone form factor comprising;

a body having a proximal end and a distal end;

an input end located at the proximal end of the body;

an output end located at the distal end of the body;

a windscreen located at the input end of the body;

wherein the capsule is located at the input end of the body behind the windscreen; and the microphone output connector is coupled to the output end of the body.

16. The personal microphone of claim 1, further comprising;

a mixing console including a phantom power supply; and a microphone cable having a first end and a second end, the microphone output connector being coupled to the first end of microphone cable and the mixing console being coupled to the second end of microphone cable;

wherein the phantom power supply provides the phantom DC voltage to the microphone output connector through the mixing console and the microphone cable.

17. The personal microphone of claim 1, wherein the dynamic range compressor includes an automatic gain control for changing a signal gain in response to an analog signal derived from the input signal.

18. The personal microphone of claim 17, wherein the automatic gain control includes;

a light bulb having a filament; and an amplifier for providing a drive signal responsive to the analog signal;

wherein the drive signal induces a drive current to flow through the filament.

19. The personal microphone of claim 17, wherein the automatic gain control includes a gain controlled amplifier and a controller, the controller converting the analog signal into a control signal, and the gain controlled amplifier receiving the control signal to control the signal gain.

20. A personal microphone that receives a phantom direct current (DC) voltage and provides a processed output signal having a dynamic range, the personal microphone comprising;

a microphone output connector for receiving the phantom DC voltage and providing the processed output signal, the microphone output connector comprising pins suitably arranged for coupling to a 3-pin female XLR connector;

a structure having a form factor for live performance;

a capsule for receiving acoustic energy and generating an input signal; and an adjustable signal processor for converting the input signal into the processed output signal, the adjustable signal processor being located in the structure; the adjustable signal processor comprising;

signal input terminals coupled to the capsule for receiving the input signal from the capsule;

input/output terminals coupled to the microphone output connector for receiving the phantom DC voltage from the microphone output connector, the input/output terminals providing the processed output signal to the microphone output connector;

a dynamic range compressor for compressing the dynamic range of the processed output signal; and an adjustment device for adjusting operating parameters of the adjustable signal processor.

21. The personal microphone of claim 20, further comprising a security device for avoiding unwanted changes to the operating parameters of the adjustable signal processor.

22. The personal microphone of claim 21, wherein the security device includes an access hole located in the structure, the adjustable signal processor being removed from the structure through the access hole.

23. The personal microphone of claim 21, wherein the adjustment device includes a potentiometer having an actuator, the actuator being adjusted to change the resistance of the potentiometer to change the operating parameters of the programmable signal processor.

24. The personal microphone of claim 20, wherein the dynamic range compressor includes an automatic gain control for changing signal gain in response to an analog signal derived from the input signal.

25. The personal microphone of claim 24, wherein the automatic gain control includes:

a light bulb having a filament; and an amplifier for providing a drive signal responsive to the analog signal;

wherein the drive signal induces a drive current to flow through the filament.

26. The personal microphone of claim 24, wherein the automatic gain control includes a gain controlled amplifier and a controller, the controller converts the analog signal into a control signal, and the gain controlled amplifier receives the control signal to control the signal gain.

27. A microphone comprising;

a body having a proximal end and a distal end;

an input end located at the proximal end of the body;

an output end located at the distal end of the body; and a windscreen located at the input end of the body;

a capsule located at the input end of the body behind the windscreen, the capsule converting acoustic energy into an input signal;

an adjustable locating device for changing the location of the capsule relative to the windscreen;

a microphone output connector for providing an output signal responsive to the input signal, the output signal having a dynamic range, the microphone output connector comprising pins suitably arranged for coupling to a 3-pin female XLR connector;

wherein the capsule includes a proximity effect to provide a bass boost in the output signal, and adjusting the location of the capsule relative to the windscreen using the adjustable locating device changes the bass boost caused by the proximity effect.

28. The microphone of claim 27, wherein the adjustable locating device includes a removable ring located between the body and the windscreen, and the removable ring is removed to increase the bass boost.

29. The microphone of claim 27, wherein the adjustable locating device includes a capsule locating device and a lock device, the capsule protruding a predetermined protrusion distance relative to the input end of the body toward the front of the windscreen, the capsule locating device moving the capsule to change the protrusion distance and the bass boost, wherein the lock device prevents unintentional movement of the capsule relative to the front of the windscreen.

30. The microphone of claim 27, further comprising a dynamic range compressor located in the body for compressing the dynamic range of the output signal.

* * * * *